US010791783B1

(12) United States Patent
Waters

(10) Patent No.: US 10,791,783 B1
(45) Date of Patent: Oct. 6, 2020

(54) LIGHTED HEADGEAR AND ACCESSORIES THEREFOR

(71) Applicant: Waters Industries, Inc., West Dundee, IL (US)

(72) Inventor: Michael Waters, Aspen, CO (US)

(73) Assignee: Waters Industries, Inc., West Dundee, IL (US)

( * ) Notice: Subject to any disclaimer, the term of this patent is extended or adjusted under 35 U.S.C. 154(b) by 0 days.

(21) Appl. No.: 16/414,624

(22) Filed: May 16, 2019

(51) Int. Cl.

| | |
|---|---|
| ***F21L 4/00*** | (2006.01) |
| ***A42B 1/24*** | (2006.01) |
| ***A42B 1/06*** | (2006.01) |
| ***F21V 23/04*** | (2006.01) |
| *F21Y 115/10* | (2016.01) |
| *F21W 131/30* | (2006.01) |

(52) U.S. Cl.
CPC ..... *A42B 1/244* (2013.01); *A42B 1/062* (2013.01); *F21L 4/00* (2013.01); *F21V 23/04* (2013.01); *F21W 2131/30* (2013.01); *F21Y 2115/10* (2016.08)

(58) Field of Classification Search
CPC ..... A42B 1/244; A42B 1/062; F21V 23/04; F21L 4/00; F21Y 2115/10; F21W 2131/30
See application file for complete search history.

(56) References Cited

U.S. PATENT DOCUMENTS

| | | | |
|---|---|---|---|
| 645,984 | A | 3/1900 | Tournier |
| 909,742 | A | 1/1909 | Borchert |
| 1,098,628 | A | 6/1914 | Hyman |
| 1,109,415 | A | 9/1914 | Harris |
| 1,261,824 | A | 1/1918 | La Vine |
| 1,255,265 | A | 2/1918 | Zachara |
| 1,323,822 | A | 12/1919 | Bramming |
| D58,302 | S | 7/1921 | Bartholomew |
| 1,438,586 | A | 12/1922 | Eaton |
| 1,448,353 | A | 3/1923 | Barany |
| 1,475,653 | A | 11/1923 | Rosenberg |
| 1,572,210 | A | 2/1926 | Kolibas |
| 1,615,067 | A | 1/1927 | Boerman |
| 1,744,777 | A | 1/1930 | Lundgren |
| 1,749,998 | A | 3/1930 | Collins |
| 1,879,512 | A | 9/1932 | Rotea |
| 1,883,756 | A | 10/1932 | Bloom |
| D114,980 | S | 1/1939 | Wengen |

(Continued)

FOREIGN PATENT DOCUMENTS

| | | |
|---|---|---|
| AU | 1178576 | 9/1977 |
| AU | 6310994 | 11/1994 |

(Continued)

OTHER PUBLICATIONS

Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).

(Continued)

*Primary Examiner* — Donald L Raleigh
(74) *Attorney, Agent, or Firm* — Fitch, Even, Tabin & Flannery LLP

(57) ABSTRACT

There is provided lighted headgear having various configurations, components thereof, and other accessories combined therewith. Also provided are a light module and a battery pack.

35 Claims, 10 Drawing Sheets

(56) References Cited

U.S. PATENT DOCUMENTS 2,196,543 A 4/1940 Anderson
2,373,553 A 10/1942 Fetterman
D137,375 S 2/1944 Heit
2,369,829 A 2/1945 Johnson
2,461,254 A 2/1949 Bassett
2,473,394 A 6/1949 Scott
2,531,585 A 11/1950 Pope
2,540,435 A 2/1951 Ferguson
2,552,764 A 5/1951 Bedford, Jr.
2,567,046 A 9/1951 Anderson
2,591,112 A 4/1952 Zwierzynski
2,638,532 A 5/1953 Brady
2,640,980 A 6/1953 Prupis
2,705,751 A 4/1955 Harris
2,730,720 A 1/1956 Saunders
2,788,439 A 4/1957 Hesse
2,904,670 A 9/1959 Calmes
2,966,580 A 12/1960 Taylor
2,978,696 A 4/1961 Keller
3,008,040 A 11/1961 Moore
3,032,647 A 5/1962 Wansky
3,040,881 A 6/1962 McNeill
3,057,992 A 10/1962 Baker
3,060,308 A 10/1962 Fortuna
3,123,208 A 3/1964 Barnum
3,184,058 A 5/1965 Crowther
3,201,771 A 8/1965 Proulx
D207,919 S 6/1967 Fai
3,350,552 A 10/1967 Lawrence
3,358,137 A 12/1967 Sinclair
3,447,164 A 6/1969 Greenhouse
D215,751 S 10/1969 Castellano
3,491,374 A 1/1970 Frangos
3,535,282 A 10/1970 Mallory
3,537,909 A 11/1970 Horton
3,602,759 A 8/1971 Evans
3,634,676 A 1/1972 Castellano
3,647,059 A 3/1972 Humphreys
3,666,901 A 5/1972 Weinhart
3,683,168 A 8/1972 Tatje
3,740,545 A * 6/1973 Franklin ..... F21S 8/08
362/297
3,749,902 A 7/1973 Drew
3,769,663 A 11/1973 Perl
D229,975 S 1/1974 Klugmann
3,793,517 A 2/1974 Carlini
3,845,389 A 10/1974 Phillips
3,947,676 A 3/1976 Battilana
3,963,917 A 6/1976 Romano
4,005,776 A 2/1977 Seeley
4,011,600 A 3/1977 Malk
4,053,688 A 10/1977 Perkins
4,092,704 A 5/1978 Malm
4,176,932 A 12/1979 Young et al.
4,186,429 A 1/1980 Johnston
4,210,952 A 7/1980 Ressmeyer
4,231,079 A 10/1980 Heminover
4,254,451 A 3/1981 Cochran, Jr.
4,268,894 A 5/1981 Bartunek
4,270,227 A 6/1981 Wolfe
4,283,127 A 8/1981 Rosenwinkel et al.
4,298,913 A 11/1981 Lozar
4,317,162 A 2/1982 Richards et al.
4,332,007 A 5/1982 Gibstein et al.
4,364,107 A 12/1982 Wieczorek
4,392,183 A 7/1983 Ostlund et al.
4,398,237 A 8/1983 Doyel
4,406,040 A 9/1983 Cannone
4,425,531 A 1/1984 Holmes
D272,733 S 2/1984 Cosmos
4,430,532 A 2/1984 Matsumoto
4,442,478 A 4/1984 Stansbury
4,462,064 A 7/1984 Schweitzer
4,470,263 A 9/1984 Lehovec
4,483,021 A 11/1984 McCall
4,516,157 A 5/1985 Campbell
4,521,831 A 6/1985 Thayer
4,541,698 A 9/1985 Lerner
4,551,857 A 11/1985 Galvin
4,553,851 A 11/1985 Matsumoto
4,559,516 A 12/1985 Schott
4,570,206 A 2/1986 Deutsch
4,602,191 A 7/1986 Davila
4,604,760 A 8/1986 Coin
4,616,297 A 10/1986 Liu
4,631,644 A 12/1986 Dannhauer
4,638,410 A 1/1987 Barker
4,641,647 A 2/1987 Behan
4,642,817 A 2/1987 Ferstenfeld
4,665,568 A 5/1987 Stutes
4,667,274 A 5/1987 Daniel
4,669,610 A 6/1987 Lindsey
4,680,815 A 7/1987 Hirsch
4,774,643 A 9/1988 McGinnis et al.
4,794,496 A 12/1988 Lanes
4,817,212 A 4/1989 Benoit
4,822,160 A 4/1989 Tsai
4,822,161 A 4/1989 Jimmy
4,827,384 A 5/1989 VonSchlemmer
4,829,285 A 5/1989 Brand et al.
4,872,218 A 10/1989 Holt
4,875,147 A 10/1989 Auer
4,884,067 A 11/1989 Nordholm et al.
4,901,210 A 2/1990 Hanabusa
4,901,211 A 2/1990 Shen
4,902,119 A 2/1990 Porsche
4,904,078 A 2/1990 Gorike
4,920,466 A 4/1990 Liu
4,945,458 A 7/1990 Batts et al.
4,951,068 A 8/1990 Ichikawa
4,959,760 A 9/1990 Wu
4,963,045 A 10/1990 Willcox
4,969,069 A 11/1990 Eichost
4,991,068 A 2/1991 Mickey
4,998,187 A 3/1991 Herrick
5,003,640 A 4/1991 Pizzacar
D316,932 S 5/1991 Escher, Jr.
5,039,829 A 8/1991 Brucksch
5,060,814 A 10/1991 Oglesbee
5,068,771 A 11/1991 Savage, Jr.
5,070,436 A 12/1991 Alexander et al.
5,088,127 A 2/1992 Thornock
5,111,366 A 5/1992 Rife
5,113,325 A 5/1992 Eisenbraun
5,117,510 A 6/1992 Broussard et al.
5,122,943 A 6/1992 Pugh
5,138,538 A 8/1992 Sperling
5,140,116 A 8/1992 Schmitt-Walter
5,140,220 A 8/1992 Hasegawa
5,143,443 A 9/1992 Madsen
5,158,356 A 10/1992 Guthrie
5,163,420 A 11/1992 VanDerBel
5,164,749 A 11/1992 Shelton
5,165,789 A 11/1992 Womack
5,183,326 A 2/1993 Case
5,189,512 A 2/1993 Cameron et al.
5,193,220 A 3/1993 Ichinohe
5,193,347 A 3/1993 Apisdorf
5,207,500 A 5/1993 Rios et al.
5,218,385 A 6/1993 Lii
5,224,772 A 7/1993 Fustos
5,230,558 A 7/1993 Jong
5,238,344 A 8/1993 Nagayama
5,245,516 A 9/1993 de Haas et al.
5,249,675 A 10/1993 Strauss
D343,470 S 1/1994 Yuen
5,278,734 A 1/1994 Ferber
D349,123 S 7/1994 Cooley et al.
5,329,637 A 7/1994 Walker
5,331,333 A 7/1994 Tagawa et al.
5,331,357 A 7/1994 Cooley et al.
5,353,205 A 10/1994 Hudak
5,357,409 A 10/1994 Glatt
5,363,291 A 11/1994 Steiner

(56) References Cited

U.S. PATENT DOCUMENTS 5,367,345 A 11/1994 da Silva
5,404,593 A 4/1995 Kronenberger
5,408,393 A 4/1995 Becker
5,410,746 A 4/1995 Gelber
5,412,545 A 5/1995 Rising
5,418,565 A 5/1995 Smith
5,423,419 A 6/1995 Wentz
5,425,620 A 6/1995 Stroud
5,438,698 A 8/1995 Burton et al.
5,452,190 A 9/1995 Priesemuth
5,460,346 A 10/1995 Hirsch
5,463,538 A 10/1995 Womack
5,467,992 A 11/1995 Harkness
5,485,358 A 1/1996 Chien
5,488,361 A 1/1996 Perry
5,503,637 A 4/1996 Kyricos
5,508,900 A 4/1996 Norman
5,510,961 A 4/1996 Peng
5,541,767 A 7/1996 Murphy et al.
5,541,816 A 7/1996 Miserendino
5,542,627 A 8/1996 Crenshaw
5,546,099 A 8/1996 Quint et al.
5,564,128 A 10/1996 Richardson
5,567,038 A 10/1996 Lary
D375,372 S 11/1996 Allen
5,575,554 A 11/1996 Guritz
5,601,358 A 2/1997 Chien
5,606,743 A 2/1997 Vogt et al.
5,608,808 A 3/1997 da Silva
5,610,678 A 3/1997 Tsuboi et al.
5,644,189 A 7/1997 Busby
5,655,374 A 8/1997 Santilli
D383,754 S 9/1997 Yuen
D383,863 S 9/1997 Yuen
5,667,291 A 9/1997 Caplan
5,667,292 A 9/1997 Sabalvaro, Jr.
5,676,449 A 10/1997 Newsome
5,677,079 A 10/1997 DeZorzi
5,680,718 A 10/1997 Ratcliffe
5,688,039 A 11/1997 Johnson
D388,113 S 12/1997 Feinbloom
5,692,244 A 12/1997 Johnson
5,708,449 A 1/1998 Heacock
5,709,464 A 1/1998 Tseng
5,718,335 A 2/1998 Boudreaux
5,722,762 A 3/1998 Soli
5,730,290 A 3/1998 Futo
5,741,060 A 4/1998 Johnson
5,743,621 A 4/1998 Mantha
5,758,947 A 6/1998 Glatt
5,774,338 A 6/1998 Wessling, III
5,786,665 A 7/1998 Ohtsuki et al.
5,800,278 A 9/1998 Varriano
5,806,961 A 9/1998 Dalton et al.
5,822,636 A 10/1998 Cho
5,829,063 A 11/1998 Cheng
5,829,860 A 11/1998 Lawther et al.
5,836,673 A 11/1998 Lo
5,845,778 A 12/1998 Hickey, Jr.
5,845,987 A 12/1998 Painter
5,857,220 A 1/1999 Erny
5,865,333 A 2/1999 Wolfe
5,871,271 A 2/1999 Chien
D407,187 S 3/1999 Makki
5,876,241 A 3/1999 Frantz
5,893,631 A 4/1999 Padden
5,894,604 A 4/1999 Crabb
5,918,966 A 7/1999 Arnold
5,920,910 A 7/1999 Calvo
5,921,674 A 7/1999 Koczi
5,922,489 A 7/1999 Adachi
5,931,693 A 8/1999 Yamazaki
5,946,071 A 8/1999 Feldman
5,982,969 A 11/1999 Sugiyama
5,997,165 A 12/1999 Lehrer
6,005,536 A 12/1999 Beadles et al.
6,007,212 A 12/1999 Chan
6,007,213 A 12/1999 Baumgartner
6,009,563 A 1/2000 Swanson
6,012,822 A 1/2000 Robinson
6,012,827 A 1/2000 Caplan et al.
D420,035 S 2/2000 Hartman
D420,207 S 2/2000 Barton et al.
6,021,525 A 2/2000 Mertins
6,023,788 A 2/2000 McCallum
6,028,627 A 2/2000 Helmsderfer
6,032,291 A 3/2000 Asenguah
6,032,293 A 3/2000 Makki
6,056,413 A 5/2000 Urso
D428,431 S 7/2000 Jordan
6,086,214 A 7/2000 Ridge
6,087,037 A 7/2000 Rieder
6,088,053 A 7/2000 Hammack
6,094,749 A 8/2000 Proctor
6,113,243 A 9/2000 Saul
6,113,244 A 9/2000 Baumgartner
6,116,745 A 9/2000 Yei
6,124,056 A 9/2000 Kimura
6,126,294 A 10/2000 Koyama
6,167,570 B1 1/2001 Su
6,168,286 B1 1/2001 Duffy
6,172,657 B1 1/2001 Kamakura et al.
6,174,075 B1 1/2001 Fuwausa
6,176,601 B1 1/2001 Nester
6,206,543 B1 3/2001 Henry
6,236,007 B1 5/2001 Ho
6,237,147 B1 5/2001 Brockman
6,240,566 B1 6/2001 Scantlin
6,244,721 B1 6/2001 Rodriguez
6,250,769 B1 6/2001 Kirk
D445,928 S 7/2001 Sharrah et al.
6,256,795 B1 7/2001 Habel
D446,324 S 8/2001 Lynch et al.
6,290,368 B1 9/2001 Lehrer
6,299,323 B1 10/2001 Yu et al.
6,302,570 B1 10/2001 Petell et al.
6,306,538 B1 10/2001 Saitoh
6,307,526 B1 10/2001 Mann
6,311,350 B1 11/2001 Kaiserman
6,311,837 B1 11/2001 Blaustein et al.
6,320,822 B1 11/2001 Okeya et al.
6,325,521 B1 12/2001 Gregg
6,328,454 B1 12/2001 Davis
6,340,234 B1 1/2002 Brown, Jr.
6,345,716 B1 2/2002 Chapman
6,347,410 B1 2/2002 Lee
6,363,537 B1 4/2002 Park
6,366,344 B1 4/2002 Lach
6,367,949 B1 4/2002 Pederson
D457,670 S 5/2002 Allen
6,382,407 B1 5/2002 Chao
6,386,701 B1 5/2002 Khulusi
6,390,640 B1 5/2002 Wong et al.
6,398,386 B1 6/2002 Huang
6,416,199 B1 7/2002 Heine
6,431,904 B1 8/2002 Berelsman
6,439,738 B1 8/2002 Matthews et al.
6,442,764 B1 9/2002 Badillo
6,457,838 B1 10/2002 Dugmore et al.
6,461,015 B1 10/2002 Welch
6,461,025 B1 10/2002 Payne
6,474,830 B1 11/2002 Hansen
6,476,391 B1 11/2002 Zhang
6,497,493 B1 12/2002 Theisen
D469,198 S 1/2003 Olson
6,504,099 B2 1/2003 Huang
6,523,973 B2 2/2003 Galli
6,530,672 B2 3/2003 Galli
6,538,567 B2 3/2003 Stewart
D473,890 S 4/2003 Waters
6,549,231 B1 4/2003 Matsui
6,553,570 B1 4/2003 Flynn
6,554,444 B2 4/2003 Shimada et al.
6,578,982 B1 6/2003 Lynch

(56) References Cited

U.S. PATENT DOCUMENTS

D477,432 S 7/2003 Parsons
6,598,991 B2 7/2003 Altman
6,604,837 B2 8/2003 Sandberg
6,612,695 B2 9/2003 Waters
6,612,696 B2 9/2003 Waters
6,616,293 B2 9/2003 Mickey
6,634,031 B1 10/2003 Schlapkohl
6,642,667 B2 11/2003 Avis
D483,928 S 12/2003 Mansell et al.
6,659,618 B2 12/2003 Waters
D484,905 S 1/2004 Waters
6,679,615 B2 1/2004 Spearing
6,704,044 B1 3/2004 Foster
6,709,142 B2 3/2004 Gyori
6,713,956 B2 3/2004 Hsing Chen et al.
6,715,309 B1 4/2004 Junkins
6,719,437 B2 4/2004 Lary
6,721,962 B1 * 4/2004 Polaire ..... A42B 1/244 2/209.13
D489,165 S 5/2004 Waters
6,733,150 B1 5/2004 Hanley
6,749,166 B2 6/2004 Valentine et al.
6,760,925 B1 7/2004 Maxwell
6,764,194 B1 7/2004 Cooper
6,802,636 B1 10/2004 Bailey, Jr.
6,808,284 B1 10/2004 Chao
6,811,441 B2 11/2004 Simpson
6,817,711 B2 11/2004 Schubert
6,830,357 B2 12/2004 Lopez
D501,266 S 1/2005 Harris, Jr. et al.
6,837,590 B2 1/2005 Marston
6,857,739 B1 2/2005 Watson
6,860,628 B2 3/2005 Robertson
6,863,416 B2 3/2005 Waters
6,865,285 B1 3/2005 Villa-Aleman
6,880,989 B2 4/2005 Sotome
6,908,208 B1 6/2005 Hyde
D507,368 S 7/2005 Waters
D507,369 S 7/2005 Waters
6,918,678 B2 7/2005 McClanahan
6,923,322 B2 8/2005 Lenker
6,929,375 B2 8/2005 Satomi
6,929,878 B2 8/2005 Chen et al.
6,932,216 B2 8/2005 Blaustein
6,935,761 B2 8/2005 Vanderschuit
6,941,583 B2 9/2005 Yan
6,966,668 B2 11/2005 Cugini
6,969,178 B2 11/2005 Zuloff
6,977,776 B2 12/2005 Volkenandt et al.
6,993,803 B2 2/2006 Chan
6,994,445 B1 2/2006 Pomes
6,997,552 B1 2/2006 Hung
7,000,841 B2 2/2006 Becker
7,003,353 B1 2/2006 Parkhouse
7,004,439 B1 2/2006 Taylor
7,004,582 B2 2/2006 Jannard et al.
7,008,074 B1 3/2006 Halm
7,021,790 B2 4/2006 Parsons
D520,460 S 5/2006 Wadsworth
7,052,154 B2 5/2006 Vanderschuit
7,055,179 B2 6/2006 Warner et al.
7,086,749 B1 8/2006 Hanley
7,094,981 B2 8/2006 Sorrentino et al.
7,104,670 B2 9/2006 Waters
7,105,939 B2 9/2006 Bednyak
7,111,956 B2 9/2006 Brown
7,114,823 B2 10/2006 McCullough et al.
7,118,241 B2 10/2006 Sohn
7,118,262 B2 10/2006 Negley
7,128,434 B1 10/2006 Nally
7,143,451 B2 12/2006 Lundgren
7,147,324 B2 12/2006 Jannard et al.
7,147,338 B2 12/2006 Gregg
7,150,526 B2 12/2006 Jannard et al.
7,163,309 B2 1/2007 Sohn
7,182,478 B2 2/2007 Marston
7,186,159 B1 3/2007 Baxter
7,192,151 B2 3/2007 Clupper
7,209,652 B2 4/2007 Uenaka
7,213,917 B2 5/2007 Jannard et al.
7,216,973 B2 5/2007 Jannard et al.
7,234,831 B1 6/2007 Hanley
7,226,180 B2 7/2007 Sung
7,255,437 B2 8/2007 Howell et al.
7,264,350 B2 9/2007 Jannard et al.
D553,177 S 10/2007 Chen
7,278,734 B2 10/2007 Jannard et al.
7,281,826 B2 10/2007 Huang
7,318,654 B2 1/2008 McClanahan
7,331,064 B1 2/2008 Quintal
D566,044 S 4/2008 DArco
D568,922 S 5/2008 Anderl
7,369,174 B2 5/2008 Olita
7,377,664 B2 5/2008 Waters
7,377,666 B1 5/2008 Tyler
7,427,149 B2 9/2008 Sohn
7,431,472 B2 10/2008 Becker
7,438,409 B2 10/2008 Jordan
7,457,536 B2 11/2008 Hamada et al.
7,461,764 B2 12/2008 Thompson
7,466,040 B2 12/2008 Bruwer
7,470,022 B2 12/2008 Lerner
7,506,992 B2 3/2009 Carter
D591,675 S 5/2009 Waters
7,562,979 B2 7/2009 Waters
7,576,800 B2 8/2009 Swain
D600,208 S 9/2009 Waters
D600,738 S 9/2009 Su et al.
7,598,928 B1 10/2009 Buskop
7,607,775 B2 10/2009 Hermanson et al.
7,609,295 B2 10/2009 Aridome
7,611,255 B1 11/2009 Lagassey
7,621,000 B1 11/2009 Fulton
D605,381 S 12/2009 Mastrantonio et al.
7,661,818 B2 2/2010 Waters
D611,086 S 3/2010 Meng-Suen
7,677,751 B2 3/2010 Kinsman
7,699,486 B1 4/2010 Beiner
D617,826 S 6/2010 Waters
7,753,547 B2 7/2010 Waters
7,755,219 B2 7/2010 Bruwer
7,784,960 B2 8/2010 Lahtinen
7,862,979 B2 1/2011 Waters
7,934,846 B1 5/2011 Schwanz
7,938,553 B1 5/2011 Beiner
7,942,543 B2 5/2011 Ritter
8,002,437 B2 8/2011 Sohn
8,075,153 B2 12/2011 Werner
8,141,395 B2 3/2012 Dillavou
8,157,403 B2 4/2012 Lau
D659,351 S 5/2012 Benkendorfer
8,277,069 B2 10/2012 Zuloff
8,333,485 B2 12/2012 Waters
8,364,220 B2 1/2013 Sandmore
8,388,164 B2 3/2013 Waters
8,491,145 B2 7/2013 Waters
8,550,651 B2 10/2013 Waters
8,698,027 B2 4/2014 Anderst
8,757,831 B2 6/2014 Waters
8,757,931 B2 6/2014 Puttmann
8,769,723 B1 7/2014 Ilges et al.
8,774,420 B2 7/2014 Belafonte et al.
8,813,268 B1 * 8/2014 Fitzgerald ..... A42B 1/242 2/422
8,919,984 B1 12/2014 Fitzgerald
8,950,012 B2 2/2015 Ilges et al.
9,057,500 B2 6/2015 Opolka
D734,925 S 7/2015 Waters
9,101,174 B2 8/2015 Waters
9,526,287 B2 * 12/2016 Waters ..... A42B 1/244
9,609,902 B2 * 4/2017 Waters ..... A42B 1/24
9,872,530 B2 * 1/2018 Waters ..... A42B 1/244
10,117,476 B2 11/2018 Waters
10,159,294 B2 * 12/2018 Waters ..... A42B 1/244

(56) References Cited

U.S. PATENT DOCUMENTS

2001/0024365 A1 9/2001 Aknine
2002/0027777 A1 3/2002 Takasu
2002/0129989 A1 9/2002 Parsons
2002/0131275 A1 9/2002 Yamamoto et al.
2002/0159250 A1 10/2002 Kuo
2002/0163800 A1 11/2002 Hansen
2002/0186557 A1 12/2002 Lary et al.
2002/0187806 A1 12/2002 Jang
2003/0079387 A1 5/2003 Derose
2003/0086053 A1 5/2003 Waters
2003/0086054 A1 5/2003 Waters
2003/0106918 A1 6/2003 Hung
2003/0122958 A1 7/2003 Olita
2003/0151910 A1 8/2003 Marston
2003/0169207 A1 9/2003 Beigel
2003/0189824 A1 10/2003 Meeder et al.
2003/0206269 A1 11/2003 Waters
2003/0231489 A1 12/2003 Hsiao
2004/0001150 A1 1/2004 Schindler, II et al.
2004/0008157 A1 1/2004 Brubaker
2004/0085745 A1 5/2004 Yoshihara
2004/0128737 A1 7/2004 Gesten
2004/0141312 A1 7/2004 Henning
2004/0141316 A1 7/2004 Twardawski
2004/0165109 A1 8/2004 Lee
2004/0222638 A1 11/2004 Bednyak
2004/0240067 A1 12/2004 Marusi et al.
2004/0240204 A1 12/2004 Russ et al.
2004/0252487 A1 12/2004 McCullough
2004/0264173 A1 12/2004 Vanderschuit
2004/0264176 A1 12/2004 Vanderschuit
2005/0001433 A1 1/2005 Seelin
2005/0035925 A1 2/2005 Ostromek et al.
2005/0047116 A1 3/2005 Gagne
2005/0066422 A1 3/2005 Yan
2005/0072458 A1 4/2005 Goldstein
2005/0078473 A1* 4/2005 Zuloff ..... A42B 1/004 362/106
2005/0083676 A1 4/2005 VanderSchuit
2005/0099799 A1 5/2005 Cugini et al.
2005/0105285 A1 5/2005 Maden
2005/0161313 A1 7/2005 Sorrentino
2005/0174753 A1 8/2005 Cao
2005/0204490 A1 9/2005 Kemp et al.
2005/0211187 A1 9/2005 Harman et al.
2005/0211574 A1 9/2005 Reeve
2005/0213340 A1 9/2005 Suzuki
2005/0219837 A1 10/2005 Brown
2005/0226433 A1 10/2005 McClanahan
2005/0237479 A1 10/2005 Rose
2005/0248932 A1 11/2005 Waters
2005/0254238 A1 11/2005 Parker et al.
2005/0265015 A1 12/2005 Salazar
2006/0012974 A1 1/2006 Su
2006/0012975 A1 1/2006 Huttner et al.
2006/0037125 A1 2/2006 McDowell
2006/0091784 A1 5/2006 Conner et al.
2006/0092621 A1 5/2006 Lai
2006/0093264 A1 5/2006 Tabuchi
2006/0107952 A1 5/2006 Schlosser
2006/0125624 A1 6/2006 Ostrovsky
2006/0126323 A1 6/2006 Pomes
2006/0138440 A1 6/2006 Jyo
2006/0141828 A1 6/2006 Dean
2006/0157569 A1 7/2006 Becker
2006/0158895 A1 7/2006 Brands et al.
2006/0165160 A1 7/2006 Winningstad
2006/0198122 A1 9/2006 Senter
2006/0212994 A1 9/2006 Proctor
2006/0215393 A1 9/2006 VanderSchuit
2006/0232955 A1 10/2006 Labine
2006/0238995 A1 10/2006 Wang
2006/0239018 A1 10/2006 Jardin
2006/0263677 A1 11/2006 Tsai
2006/0285315 A1 12/2006 Tufenkjian
2006/0286443 A1 12/2006 Huang
2006/0291193 A1 12/2006 Hill
2007/0003826 A1 1/2007 Hsu
2007/0013865 A1 1/2007 Joradn
2007/0030442 A1 2/2007 Howell et al.
2007/0048598 A1 3/2007 Huang
2007/0053179 A1 3/2007 Pang
2007/0058361 A1 3/2007 Sevilla
2007/0064413 A1 3/2007 Slater
2007/0072655 A1 3/2007 Cascone
2007/0074752 A1 4/2007 Shau
2007/0086182 A1 4/2007 Kelly
2007/0097668 A1 5/2007 Choi
2007/0127250 A1 6/2007 Waters
2007/0140675 A1 6/2007 Yanagi
2007/0145746 A1 6/2007 Biamonte
2007/0153500 A1 7/2007 Waters
2007/0153537 A1 7/2007 Scott et al.
2007/0154029 A1 7/2007 Werner
2007/0159810 A1 7/2007 Kim
2007/0159823 A1 7/2007 Ho
2007/0171628 A1 7/2007 Seade
2007/0189003 A1 8/2007 Daley
2007/0206373 A1 9/2007 Whiteside et al.
2007/0236649 A1 10/2007 Lin
2007/0236915 A1 10/2007 Chen
2007/0236916 A1 10/2007 Hsu
2008/0049963 A1 2/2008 Mann et al.
2008/0068559 A1 3/2008 Howell
2008/0069391 A1 3/2008 Steyn et al.
2008/0130272 A1 6/2008 Waters
2008/0152482 A1 6/2008 Patel
2008/0186705 A1 8/2008 Liu
2008/0263750 A1 10/2008 Chen
2008/0266839 A1 10/2008 Claypool
2009/0010474 A1 1/2009 Ouryouji
2009/0126076 A1 5/2009 Ochoa
2009/0147503 A1 6/2009 Bennett
2009/0148149 A1 6/2009 Chishima
2009/0193566 A1 8/2009 Waters
2009/0213323 A1 8/2009 Mermanson
2009/0268936 A1 10/2009 Goldberg et al.
2009/0323317 A1 12/2009 Spartano
2010/0024091 A1 2/2010 Mehtab et al.
2010/0095431 A1 4/2010 Liao
2010/0134761 A1 6/2010 Johns et al.
2010/0182563 A1 7/2010 Waters
2010/0207540 A1* 8/2010 Walton ..... F21V 19/008 315/291
2010/0214767 A1 8/2010 Waters
2010/0242155 A1* 9/2010 Carullo, Jr. ..... A61N 5/0617 2/171.2
2010/0289433 A1* 11/2010 Lau ..... A42B 1/244 315/313
2010/0307931 A1 12/2010 Waters
2010/0313335 A1 12/2010 Waters
2011/0013135 A1 1/2011 Waters
2011/0075095 A1 3/2011 Waters
2011/0122601 A1 5/2011 Waters
2011/0187989 A1 8/2011 Waters
2011/0210685 A1 9/2011 Liao
2011/0211156 A1 9/2011 Beiner
2011/0228211 A1 9/2011 Waters
2011/0242799 A1* 10/2011 Dyer ..... A42B 1/244 362/105
2012/0014095 A2 1/2012 Waters
2012/0098465 A1 4/2012 Rothschild
2013/0025612 A1 1/2013 Hunter
2013/0033852 A1* 2/2013 Liao ..... A42B 1/24 362/106
2013/0111651 A1 5/2013 Waters
2013/0192961 A1 8/2013 Waters
2013/0198935 A1 8/2013 Waters
2014/0049947 A1 2/2014 Lombard et al.
2014/0101827 A1 4/2014 Dennis
2014/0173807 A1 6/2014 Waters
2014/0237706 A1 8/2014 O'Conner
2014/0268683 A1 9/2014 Waters

(56) References Cited

U.S. PATENT DOCUMENTS

| | | | | |
|---|---|---|---|---|
| 2014/0268684 | A1* | 9/2014 | Waters | F21V 21/14 362/106 |
| 2014/0270685 | A1 | 9/2014 | Letke | |
| 2015/0036324 | A1* | 2/2015 | Fitzgerald | A42B 1/242 362/106 |
| 2015/0063777 | A1* | 3/2015 | Letke | A42B 1/244 386/224 |
| 2015/0358515 | A1 | 12/2015 | Resnick | |
| 2016/0337745 | A1 | 11/2016 | Adams | |
| 2019/0178477 | A1* | 6/2019 | Ross | F21V 21/084 |

FOREIGN PATENT DOCUMENTS

| | | | |
|---|---|---|---|
| AU | 199940150 | | 2/2000 |
| AU | 199959545 | | 3/2000 |
| AU | 2002100976 | | 6/2003 |
| AU | 2003100277 | | 7/2003 |
| AU | 2003248016 | | 11/2004 |
| CA | 2029772 | | 5/1991 |
| CA | 2198625 | | 2/1997 |
| CA | 2184336 | | 5/1997 |
| CA | 2406450 | | 11/2001 |
| CA | 2466175 | A1 | 5/2003 |
| CA | 2608746 | A1 | 11/2006 |
| CA | 2610073 | A1 | 5/2008 |
| CN | 86208973 | | 10/1987 |
| CN | 2173427 | | 8/1994 |
| CN | 2239167 | | 11/1996 |
| CN | 2423761 | | 3/2001 |
| CN | 2433836 | | 6/2001 |
| CN | 2458892 | | 11/2001 |
| CN | 2508592 | | 9/2002 |
| CN | 2544551 | | 4/2003 |
| CN | 1462597 | | 12/2003 |
| CN | 1603677 | A | 4/2005 |
| CN | 101950091 | A | 1/2011 |
| CN | 301445845 | S | 1/2011 |
| CN | 201796205 | U | 4/2011 |
| DE | 3043007 | | 6/1982 |
| DE | 8230583 | | 9/1983 |
| DE | 9410886 | | 9/1994 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 102007006860 | A1 | 8/2007 |
| EP | 1072204 | | 1/2001 |
| EP | 1374707 | | 1/2004 |
| EP | 1451633 | | 9/2004 |
| EP | 2290433 | A1 | 3/2011 |
| EP | 2299311 | A1 | 3/2011 |
| EP | 2350734 | A1 | 8/2011 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2272073 | A | 5/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61006304 | | 1/1986 |
| JP | 4289602 | | 10/1992 |
| JP | H08027610 | A | 1/1996 |
| JP | H08298004 | A | 11/1996 |
| JP | H09209210 | A | 8/1997 |
| JP | H09296319 | A | 11/1997 |
| JP | H10081275 | A | 3/1998 |
| JP | H10331019 | A | 12/1998 |
| JP | 2001131818 | A | 5/2001 |
| JP | 3084061 | | 2/2002 |
| JP | 3090973 | | 10/2002 |
| JP | 2004207580 | | 7/2004 |
| JP | 2004346470 | | 12/2004 |
| JP | 2005216832 | A | 8/2005 |
| JP | 2006097156 | A | 4/2006 |
| JP | 2007119980 | | 5/2007 |
| JP | 2008542558 | | 11/2008 |
| KR | 200164075 | | 2/2000 |
| KR | 200168822 | Y1 | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |
| TW | 386364 | | 4/2000 |
| WO | 9402043 | | 2/1994 |
| WO | 9704434 | | 2/1997 |
| WO | 01013033 | A1 | 2/2001 |
| WO | 2001013033 | | 2/2001 |
| WO | 01077575 | A1 | 10/2001 |
| WO | 2001077575 | | 10/2001 |
| WO | 0244611 | | 6/2002 |
| WO | 02062165 | | 8/2002 |
| WO | 02074398 | | 9/2002 |
| WO | 02077520 | | 10/2002 |
| WO | 2003040808 | A2 | 5/2003 |
| WO | 03047377 | | 6/2003 |
| WO | 03083811 | | 10/2003 |
| WO | 2004000054 | | 12/2003 |
| WO | 2004064555 | | 5/2004 |
| WO | 2004103104 | | 12/2004 |
| WO | 2005002378 | | 1/2005 |
| WO | 2005005882 | | 1/2005 |
| WO | 2005038337 | | 4/2005 |
| WO | 2005096856 | | 10/2005 |
| WO | 2005098314 | | 10/2005 |
| WO | 2006037845 | | 4/2006 |
| WO | 2006124928 | | 11/2006 |
| WO | 2007073047 | | 6/2007 |
| WO | 2007073219 | | 6/2007 |
| WO | 2007089236 | | 8/2007 |
| WO | 2007093348 | | 8/2007 |
| WO | 2007112338 | | 10/2007 |
| WO | 2008011750 | | 1/2008 |
| WO | 2009079656 | A2 | 6/2009 |
| WO | 2010099504 | | 9/2010 |
| WO | 2011041591 | A1 | 4/2011 |
| WO | 2011100471 | A1 | 8/2011 |
| WO | 2011137400 | | 11/2011 |
| WO | 2011137406 | | 11/2011 |

(56) References Cited

FOREIGN PATENT DOCUMENTS

| | | |
|---|---|---|
| WO | 2013096895 | 6/2013 |
| WO | 2013096904 | 6/2013 |
| ZA | 20043826 A | 9/2005 |

OTHER PUBLICATIONS

"Complaint", *Waters Industries, Inc.* v. *Totes Isotoner Corporation, et al.*, United States District Court for the Northern District of Illinois, Case No. 1:10-cv-04487 (Jul. 19, 2010) (26 pages).
'Initial Non-Infringement, Invalidity and Unenforceability, Contentions' with Exhibit A, Exhibits B-1 and B-2, and Exhibits C-1 through C7, *Waters Industries, Inc.* v. *Outdoor Cap Co., Inc.*, United States District Court for the Northern District of Illinois, Case No. 1:13-cv-07191, 263 pages (Dec. 18, 2013).
'Waters Industries' Answer to Defendant's Amended Counterclaims, *Waters Industries, Inc.* v. *Outdoor Cap Co., Inc.*, United States District Court for the Northern District of Illinois, Case No. 1:13-cv-07191, 12 pages (Document No. 38, Dec. 18, 2013).
Docket report of *Waters Industries, Inc.* v. *Outdoor Cap Co., Inc.*, United States District Court for the Northern District of Oklahoma, Case No. 4:13-cv-00665-CVE-FHM, filed Oct. 8, 2013 (7 pages).
"Answer and Counterclaim of Defendant Outdoor Cap Co., Inc.," *Waters Industries, Inc.* v. *Outdoor Cap Co., Inc.*, United States District Court for the Northern District of Illinois, Case No. 1:13-cv-07191, 11 pages (Document No. 13, Oct. 30, 2013).
"Declaratory Judgment Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 52 pages (Document No. 2, Oct. 8, 2013).
"First Amended Answer and Counterclaim of Defendant Outdoor Cap Co., Inc." with Exhibit A through G, *Waters Industries, Inc.* v. *Outdoor Cap Co., Inc.*, United States District Court for the Northern District of Illinois, Case No. 1:13-cv-07191, 201 pages (Document No. 34, Dec. 11, 2013).
"Plaintiff's Complaint" with Exhibit A, *Waters Industries, Inc.* v. *Outdoor Cap Co., Inc.*, United States District Court for the Northern District of Illinois, Case No. 1:13-cv-07191, 7 pages (Document No. 1, Oct. 8, 2013).
"Plaintiff's First Amended Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 51 pages (Document No. 11, Oct. 10, 2013).
"Plaintiff's Initial Infringement Contentions Under Local Patent Rule 2.2" with Appendix A, Figures 1-5, and Exhibits 1-3, *Waters Industries, Inc.* v. *Outdoor Cap Co., Inc.*, United States District Court for the Northern District of Illinois, Case No. 1:13-cv-07191, 58 pages (Nov. 27, 2013).
"Waters Industries' Answer to Defendant's Counterclaims," *Waters Industries, Inc.* v. *Outdoor Cap Co., Inc.*, United States District Court for the Northern District of Illinois, Case No. 1:13-cv-07191, 5 pages (Document No. 28, Nov. 20, 2013).
'Panther Vision Power Beanie—Available at Bunnings Warehouse,' screenshot of a video posted to Youtube on Jun. 16, 2014. Retrieved from the Internet on Mar. 9, 2015. URL: https://www.youtube.com/watch?v=ZOWodRoEuvc. (1 page).
"4 LED Lighted Fleece Beanie; POWERCAP," article posted on-line to WISE-SHOP.ca. Added to the businesses catalog on Nov. 6, 2013. Retrieved from the Internet on Jun. 17, 2014. URL: http://www.wise-shop.ca/product_info.php?products_id=489.
"Panther Vision Powercap LED Lighted Beanie," article posted on-line and available for sale at Dick's Sporting Goods with reviews posted as early as Nov. 14, 2014. Retrieved from the Internet on Mar. 9, 2015. URL: http://www.dickssportinggoods.com/product/index.jsp?productId=52376526. (4 pages).
"Powercap Beanie," article posted on-line to Panther Vision. Publication date unknown. Retrieved from the Internet on Mar. 9, 2015. URL: http://www.panther-vision-promotional-products.com/Prod-18-1-96-10/powercap-trade-beanie.htm. (2 pages).
"Answer to Complaint, Counterclaims", filed by Sweet Baby, Inc. dba AJ Morgan, *Waters Industries, Inc.* v. *Sweet Baby, Inc. dba AJ Morgan et al.*, United States District Court for the Northern District of Illinois, Case No. 1:09-cv-07595, 15 pages (Feb. 4, 2010).
"Complaint", *Waters Industries, Inc.* v. *Kikkerland Design, Inc.*, United States District Court for the Northern District of Illinois, Case No. 1:10-cv-04076, 21 pages (Jun. 30, 2010).
"Complaint", *Waters Industries, Inc.* v. *Mr. Christmas Incorporated, et al.*, United States District Court for the Northern District of Illinois, Case No. 1:09-cv-07577, 38 pages (Dec. 7, 2009).
"Complaint", *Waters Industries, Inc.* v. *Sweet Baby, Inc. dba AJ Morgan et al.*, United States District Court for the Northern District of Illinois, Case No. 1:09-cv-07595, 78 pages (Dec. 7, 2009).
"Complaint", *Waters Industries, Inc.* v. *The Gerson Company*, United States District Court for the Northern District of Illinois, Case No. 1:10-cv-01865,71 pages (Mar. 24, 2010).
"Complaint" with Exhibit A through D, *Waters Industries, Inc.* v. *JJI International, Inc., et al.*, United States District Court for the Northern District of Illinois, Case No. 1:11-cv-03791, 73 pages (Document No. 1, Jun. 3, 2011).
"Defendants' Answer and Counterclaim" and "Responses to Specific Allegations", *Waters Industries, Inc.* v. *JJI International, Inc.* and *Stein Mart, Inc.*, United States District Court for the Northern District of Illinois, Case No. 1:11-cv-03791, 16 pages (Document No. 15, Jun. 28, 2011).
"Defendants' Initial Non-Infringement and Invalidity Contentions" with Appendix A though G, *Waters Industries, Inc.* v. *JJI International, Inc.* and *Stein Mart, Inc.*, United States District Court for the Northern District of Illinois, Case No. 1:11-cv-03791, 78 pages (Aug. 9, 2011).
"Kikkerland Design, Inc.'s Answer to Complaint, Affirmative Defenses and Counterclaim", *Waters Industries, Inc.v. Kikkerland Design, Inc.*,United States District Court for the Northern District of Illinois, Case No. 1:10-cv-04076, 12 pages (Aug. 6, 2010).
"Plaintiffs Initial Infringement Contentions Under Local Patent Rule 2.2" with Appendix A through F,*Waters Industries, Inc.* v. *JJI International, Inc.* and *Stein Mart, Inc.*, United States District Court for the Northern District of Illinois, Case No. 1:11-cv-03791, 44 pages (Jul. 26, 2011).
"Plaintiffs Initial Response to Invalidity Contentions Under Local Patent Rule 2.5" with Appendix A and B, *Waters Industries, Inc.* v. *JJI International, Inc.* and *Stein Mart, Inc.*, United States District Court for the Northern District of Illinois, Case No. 1:11-cv-03791, 29 pages (Aug. 23, 2011).
Docket report of *Waters Industries, Inc.* v. *Kikkerland Design, Inc.*, United States District Court for the Northern District of Illinois, Case No. 1:10-cv-04076, filed Jun. 30, 2010, 4 pages.
Docket report of *Waters Industries, Inc.* v. *Mr. Christmas Incorporated, et al.*, United States District Court for the Northern District of Illinois, Case No. 1:09-cv-07577, filed Dec. 7, 2009, 5 pages.
Docket report of *Waters Industries, Inc.* v. *Sweet Baby, Inc. dba AJ Morgan et al.*, United States District Court for the Northern District of Illinois, Case no. 1:09-cv-07595, filed Dec. 7, 2009, 7 pages.
Docket report of *Waters Industries, Inc.* v. *The Gerson Company*, United States District Court for the Northern District of Illinois, Case No. 1:10-cv-01865, filed Mar. 24, 2010, 3 pages.
Extended European search report issued in the related European Application No. 08 86 2753.4 dated Dec. 7, 2012 (7 pages).
Extended European search report issued in the related European Application No. 10 18 1592.6 dated Jan. 31, 2011 (7 pages).
Extended European search report issued in the related European Application No. 10 18 1593.4 dated Feb. 1, 2011 (8 pages).
International Search Report from the International Bureau of WIPO issued in the related International Application No. PCT/US02/35665, dated Jun. 27, 2003, 1 page.
Notification Concerning Transmittal of International Preliminary Report on Patentability and the Written Opinion of the International Searching Authority from the International Bureau of WIPO for International Application No. PCT/US2013/076689, dated Jul. 2, 2015, 7 pages.
Notification of Transmittal of the International Search Report and the Written Opinion of the International Searching Authority, or the

(56) References Cited

OTHER PUBLICATIONS

Declaration from the International Bureau of WIPO for International Application No. PCT/US10/50978, dated Dec. 3, 2010, 16 pages.
Notification of Transmittal of the International Search Report and the Written Opinion of the International Searching Authority, or the Declaration from the International Bureau of WIPO for International Application No. PCT/US14/28613, dated Sep. 19, 2014, 13 pages.
Notification of Transmittal of the International Search Report and the Written Opinion of the International Searching Authority, or the Declaration from the International Bureau of WIPO for International Application No. PCT/US2008/087542 dated May 4, 2009, 12 pages.
Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2011/024400, dated Apr. 29, 2011, 13 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for International Application No. PCT/US2011/051596, dated Jan. 18, 2012, 9 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.
Office Action issued in related Canadian Application No. 2,466,175 dated Sep. 22, 2010 (3 pages).
Office Action issued in related European Application No. 02 778 755.5 dated Feb. 20, 2007 (7 pages).
Office Action issued in related Japanese Application No. 2010-539834 dated Mar. 19, 2013 and English translation of the same (10 pages).
Patent Examination Report issued in related Australian Application No. 2008338320 dated Nov. 1, 2012 (5 pages).
Supplementary European search report issued in the related European Application No. 02 77 8755 dated Jan. 19, 2005 (2 pages).
Written Opinion of the International Searching Authority and International Search Report from the International Bureau of WIPO for International Application No. PCT/US2006/018968, dated Oct. 16, 2006, 12 pages.
Written Opinion of the International Searching Authority and International Search Report from the International Bureau of WIPO for International Application No. PCT/US2008/087542, dated May 4, 2009, 12 pages.
Notification of Transmittal of the International Search Report and the Written Opinion of the International Searching Authority, or the Declaration from the International Bureau of WIPO for International Application No. PCT/US2014/028945 dated Jul. 31, 2014, 9 pages.
"Answer to Complaint, Counter claims",filed by Lilian Vernon Corporation, *Waters Industries, Inc.* v. *Sweet Baby, Inc. dba AJ Morgan et al.*, United States District Court for the Northern District of Illinois, Case No. 1:09-cv-07595, 15 pages (Feb. 4, 2010).

* cited by examiner

LIGHTED HEADGEAR AND ACCESSORIES THEREFOR

FIELD OF THE INVENTION

This disclosure relates to lighting devices and, in particular, to lighted headgear and accessories therefor.

BACKGROUND

Often an individual desires a light source focused to illuminate an area while performing a task, or a light source directed in a general outward direction for visibility. Holding a flashlight is an option, but such lighting devices are often cumbersome and may detract from the task being completed because the flashlight must be held. As a result, hands-free lighting is often desired because the individual desiring illumination does not need to hold the light source. Common types of hands-free lighting include light sources mounted to headgear or eyeglasses.

Lighted headgear may include illumination sources mounted to hats. Often the light source is oriented outwardly in such a manner so that the wearer can be seen by others or oriented downward to provide light forwardly of the wearer so as to illuminate an area in the wearer's field of view. Often, the light source is one or more LEDs. Such LED lighted headgear, which may include LEDs mounted to a typical baseball-style hap or beanie-style cap, are convenient for hands-free lighting in a number of recreational activities, such as camping, hunting, fishing, jogging, or the like.

DETAILED DESCRIPTION

Figure 1:
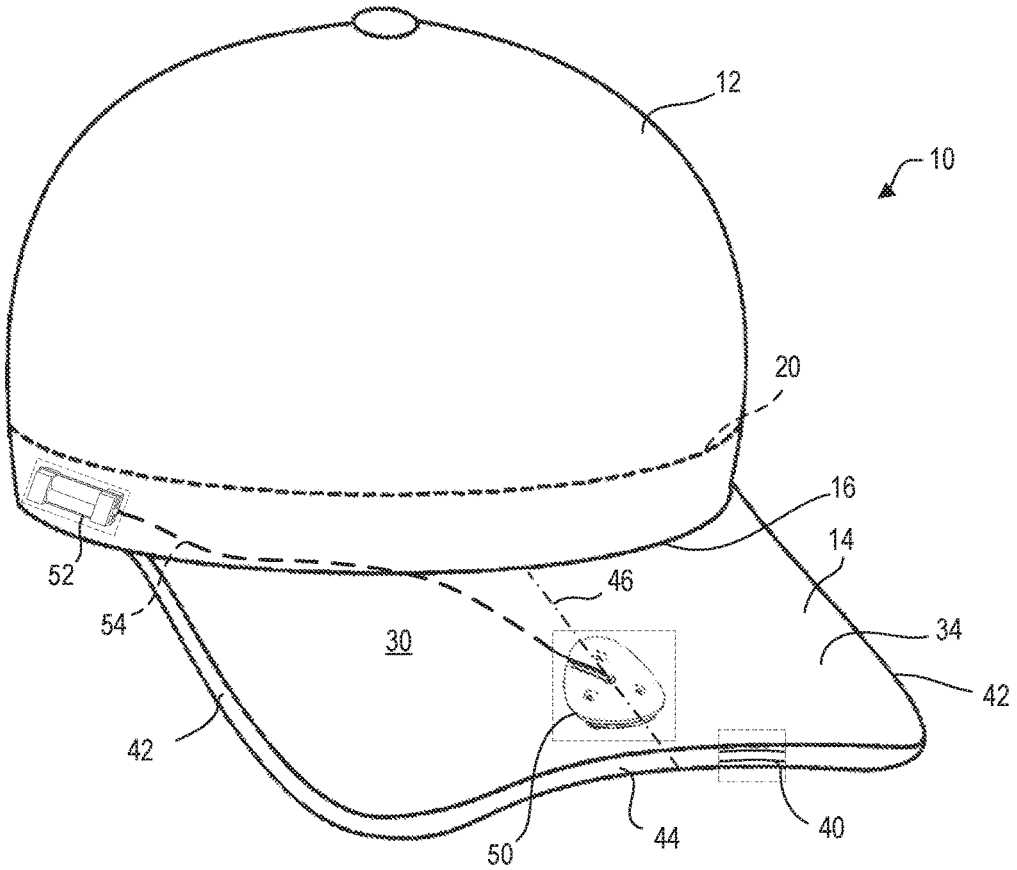
FIG. 1 is an upper perspective view of a baseball-style lighted hat having a battery pack and a light module to provide illumination generally forwardly and downwardly.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures is combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

In general, the headgear described herein include one or more illumination sources, which may include, for example, one or more light-emitting diodes (LEDs). One or more power assemblies are provided to energize these illumination sources. The power generators may use traditional batteries or renewable energy, such as solar, wind, or kinetic energy, to generate electrical power that ultimately energizes the light sources that is included on the disclosed headgear. While the following description and illustrations may describe a specific power assembly and illumination source with a specific headgear and lighting configuration, the various components described herein may be included in any of the headgear embodiments. The headgear may include, for example, a baseball-style hat, a beanie-style cap, or other suitable headgear such as visors, helmets, caps, hats, headbands, sweatband, hoods, clothing, or the like. The light modules described herein may also be mounted to other articles of clothing.

The lighted headgear described herein include a head fitting portion for fitting on a head of a user. A light module is mounted to the headgear for projecting light in the generally forward direction. The light modules discussed herein are generally low-profile light modules having ergonomically-actuated actuators. More particularly, the actuators are generally angled such that the actuating member (which may be, for example, a push-button) travels along an axis corresponding to a user's natural push direction. In the baseball-style cap example of FIGS. 1-9, the push direction is generally upward and forward relative to the user's forehead. In the beanie-style example of FIGS. 10-17, the push direction is generally downward and rearward relative to the user's forehead.

The light modules contemplated herein may include a reflector that has reflector walls for directing the light. More particularly, the reflective walls may focus the light in a generally forward direction, and optionally, in a generally downward direction. Focusing light in a generally downward direction may be particularly advantageous in light module secured to the brim of a baseball-style hat. For example, by directing light away from a downward surface of a brim portion of the hat, the reflector may reduce or inhibit glare off the brim portion.

Figure 2:
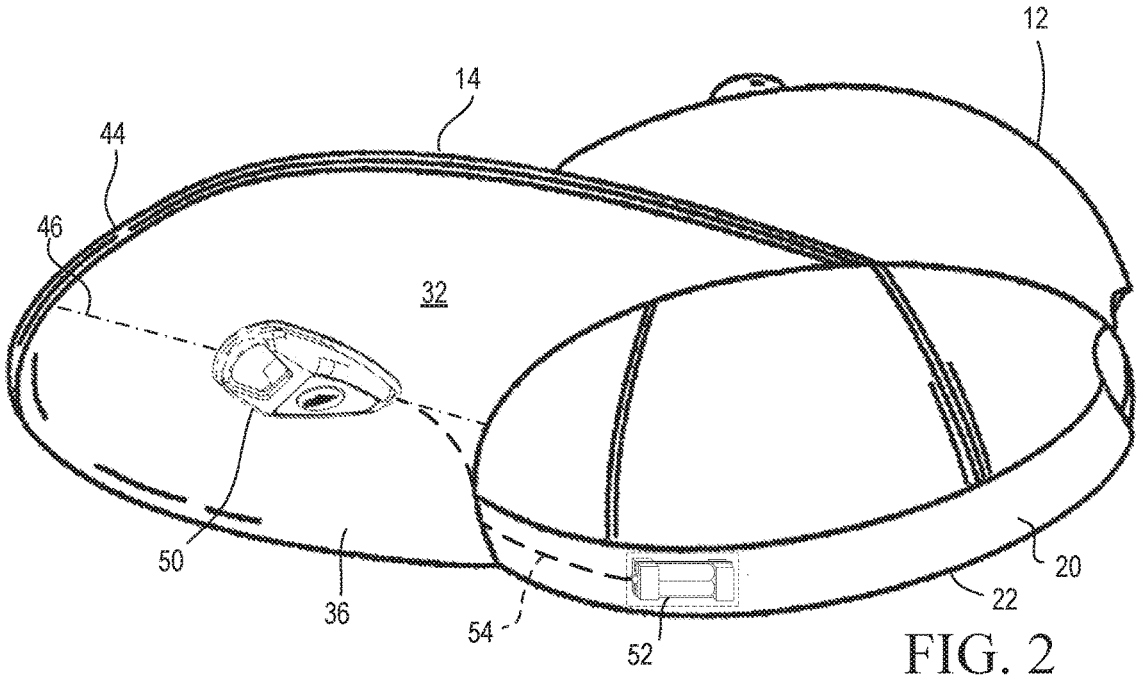
FIG. 2 is a lower perspective view of the baseball-style lighted hat of FIG. 1 showing the light module secured to the underside of a brim of the baseball-style lighted hat.

Referring to FIGS. 1 and 2, lighted headgear such as a lighted hat 10 is shown. The lighted hat 10 is be in the form of a baseball-style cap having a head fitting portion, such as crown portion 12, for fitting on a head of a user. The lighted hat 10 also includes a brim portion 14 that extends in a generally forward direction from the head fitting portion. For example, the brim portion 14 projects forwardly from a lower, forward edge 16 of the crown portion 12. In some forms, the lighted hat 10 further includes a hat band 20 disposed around a lower edge portion 22 of the inside of the lighted hat 10. The hat band 20 may be composed of an elastic and/or wicking material to conform the crown portion 12 more closely to a wearer's head and/or wick moisture away from the wearer's head.

The brim portion 14 has an upper major surface 30 and a lower major surface 32. As used herein, the upper major surface 30 faces generally upwardly when the lighted hat 10 is worn by a user, and the lower major surface 32 faces generally downwardly when the lighted hat 10 is worn by a user. The upper major surface 30 is disposed on an upper covering 34, and the lower major surface 32 is disposed on a lower covering 36. The upper and lower coverings 34, 36 is fabric coverings or other suitable material.

The brim portion 14 further includes a brim insert 40 that extends between the upper covering 34 and the lower covering 36. The brim portion 14 includes perimeter edges, such as side edges 42 and a front edge 44 that extends between the side edges 42. The brim portion 14, and more particularly, the lower major surface 32, has a generally fore-and-aft central axis 46 that extends in a forward direction between the side edges 42 and toward the front edge 44. The upper and lower coverings 34, 36 and the brim insert 40 may be joined together, such as by stitching, adhesive, or the like.

The lighted hat 10 includes a light module 50. The light module 50, discussed in greater detail with respect to FIGS. 3-9, is preferably disposed on the lower major surface 32 of the brim portion 14 (e.g., at the generally downwardly-facing surface of the brim portion 14).

Figure 18:
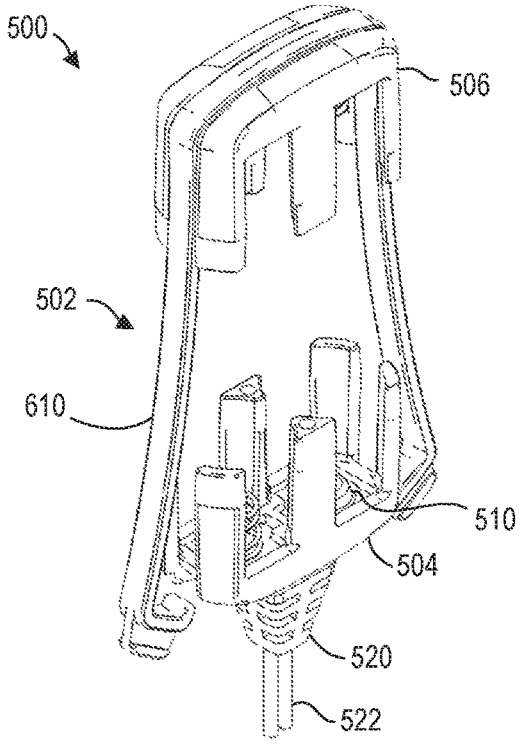
FIG. 18 is an upper perspective view of a battery holder in an unassembled configuration.
Figure 19:
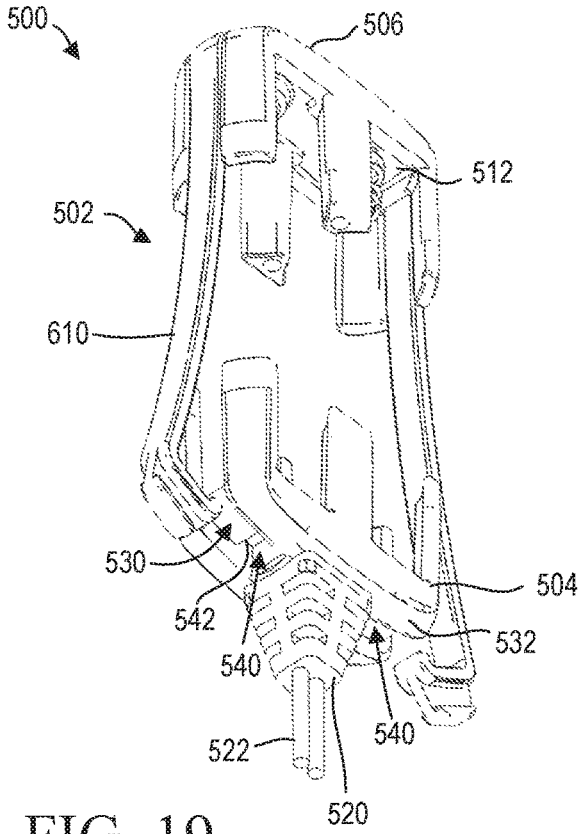
FIG. 19 is a lower perspective view of the battery holder of FIG. 18 in an unassembled configuration.
Figure 20:
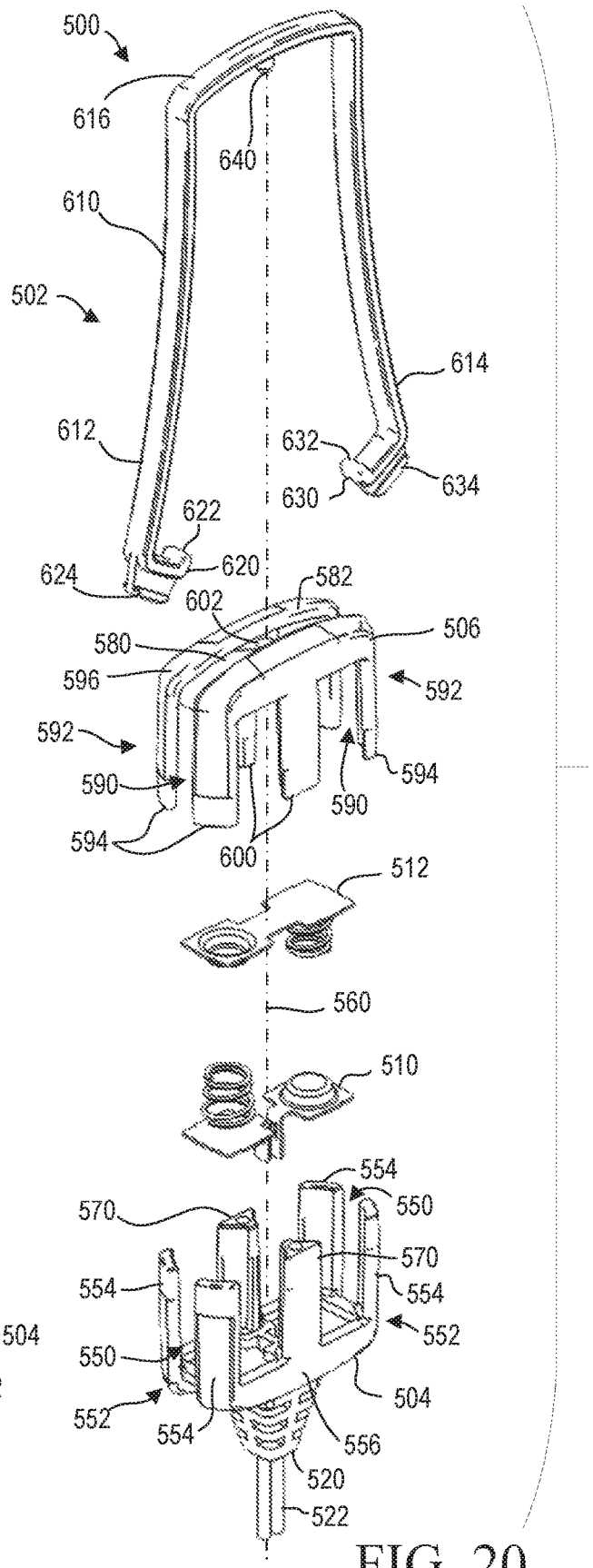
FIG. 20 is a perspective exploded view of the battery holder of FIG. 18 in an unassembled configuration.

The lighted hat 10 further includes a power source 52, and an electrical connection 54 that spans between the power source 52 and the light module 50. The electrical connection 54 may include one or more wires to provide power to the light module 50. The power source 52, discussed in greater detail with respect to FIGS. 18-20, is illustrated as a battery pack that is stored in the hat band 20 of the crown portion 12 of the lighted hat 10.

Figure 3:
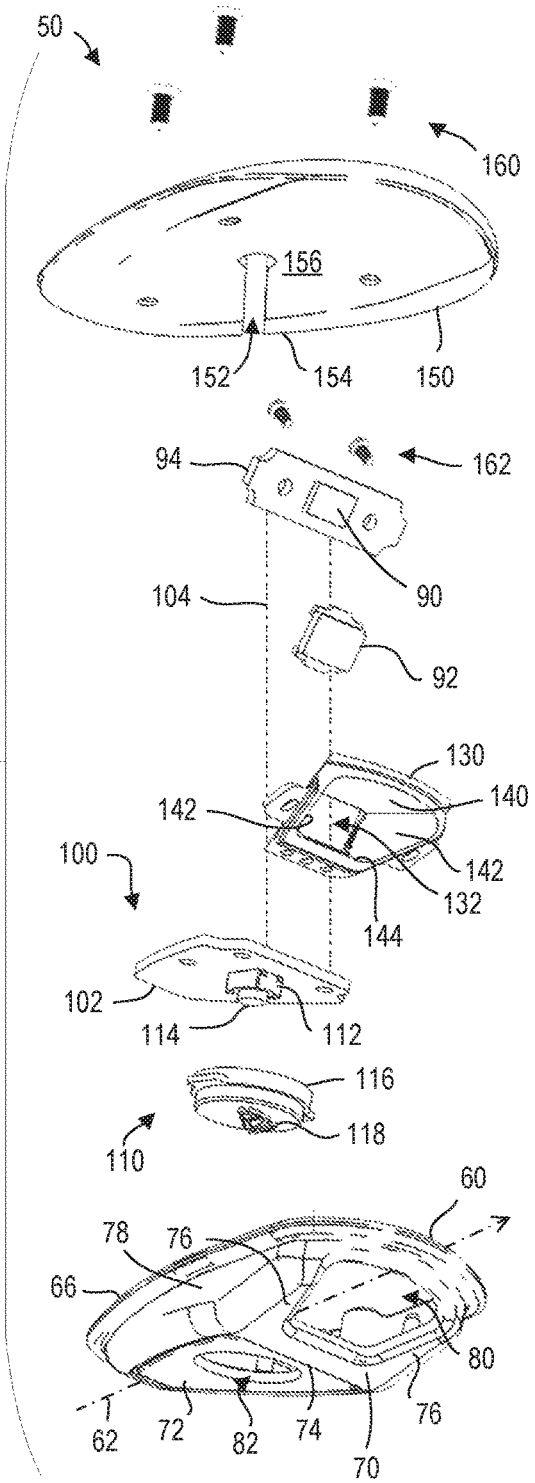
FIG. 3 is a lower perspective exploded view of the light module of FIG. 1 showing lower portions of various components of the light module.
Figure 4:
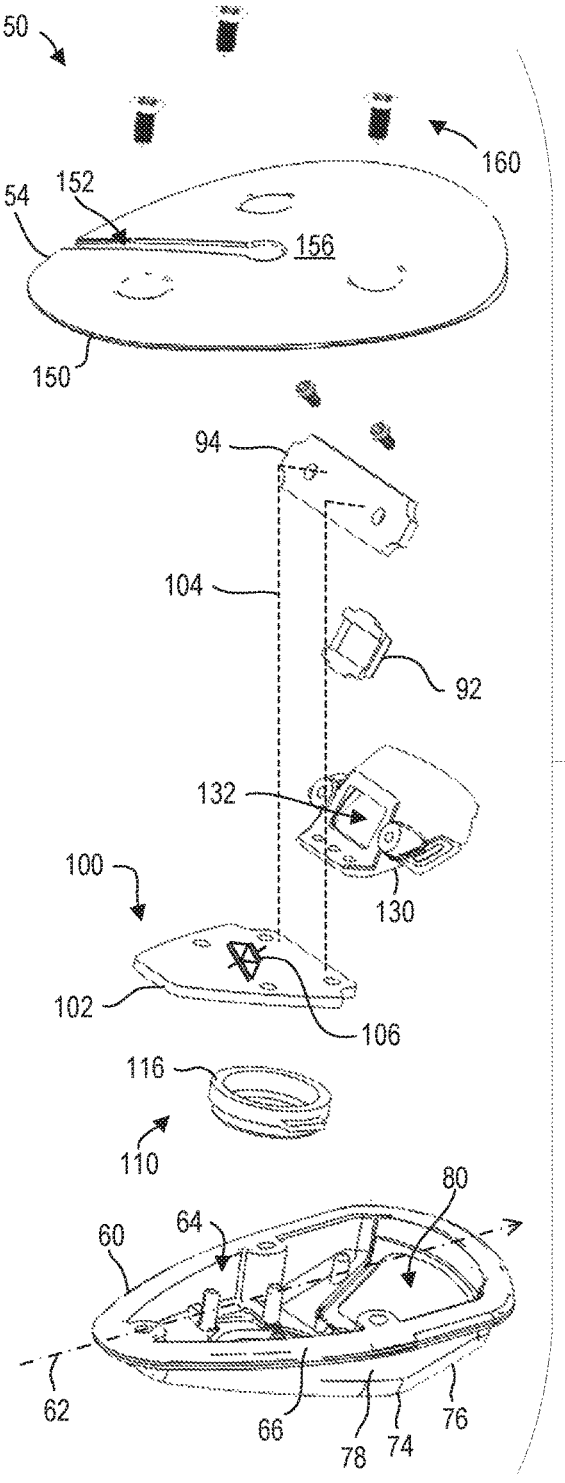
FIG. 4 is an upper perspective exploded view of the light module of FIG. 1 showing upper portions of various components of the light module.
Figure 5:
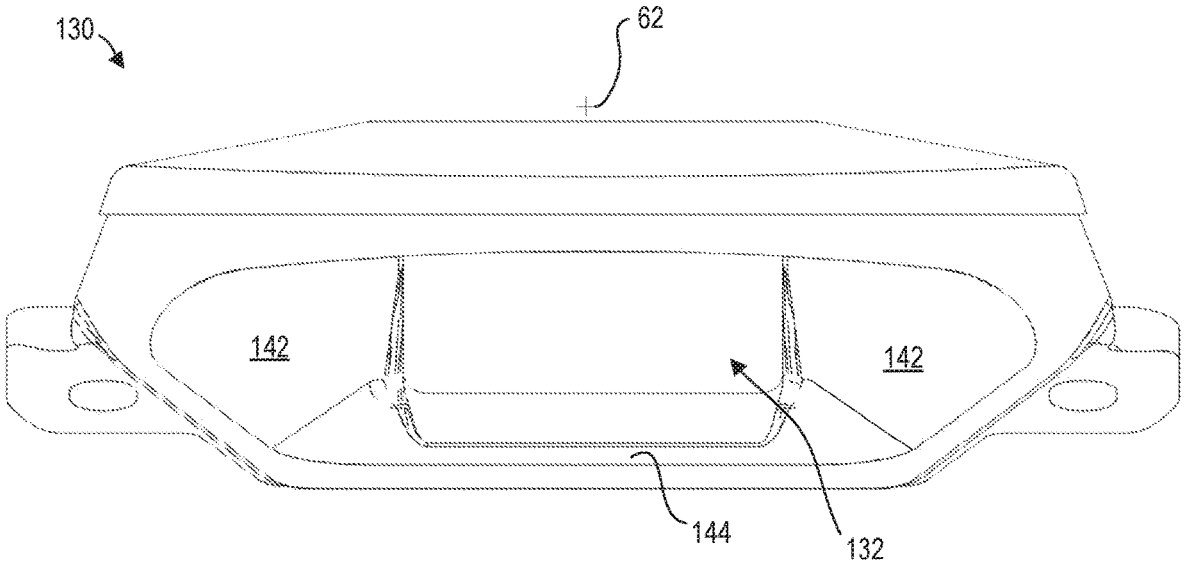
FIG. 5 is a front elevation view of a reflector of the light module of FIG. 1 showing reflector walls extending from a rearward opening of the reflector.
Figure 6:
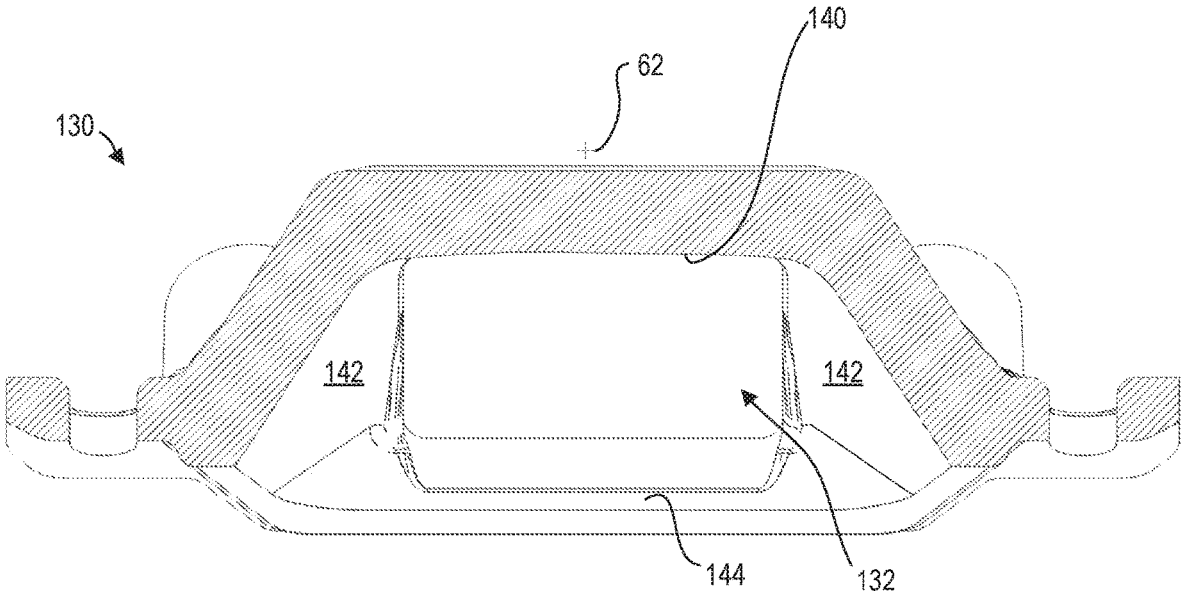
FIG. 6 is a cross-sectional view of the reflector of FIG. 5 showing the inclination of the opposing reflective side walls relative to the reflective upper wall.

Referring to FIGS. 3 and 4, the light module 50 includes a housing 60. The housing 60 has a central axis 62 that extends in a generally forward direction. The central axis 62 extends, for example, through or along a base flange 66 of the housing 60.

The housing 60 includes housing walls that extend from the base flange 66, and extend about a housing interior 64. As shown, the housing walls generally define a wedge-shaped housing. In this regard, the housing walls include a forward wall portion 70, a rearward inclined wall portion 72, and opposing side walls 78 that extend between the base flange 66 and the forward wall portion 70 and rearward inclined wall portion 72. In one approach, a side wall 78 forms a rearward curved or rounded side interface with the rearward inclined wall portion 72, and forms a forward curved or rounded side interface with the forward wall portion 70.

The forward wall portion 70 and the rearward inclined wall portion 72 converge to form an apex 74 of the housing 60. In one aspect, the apex 74 is a curved or rounded apex.

The forward wall portion 70 includes one or more opposite sections, referred to herein as side wall portions 76, that at least partially define an opening. For example, two opposing side wall portions 76 cooperate to at least partially form a forward opening 80, also referred to herein as a large light opening, therebetween.

In the approach shown, the side wall portions 76 taper as the side wall portions 76 extend in the forward direction along the central axis 62. For example, the lateral width (e.g., in a direction orthogonal to the central axis 62) of a side wall portion 76 varies from a maximum width closest to a apex 74, to a minimum width farthest from the apex 74. A side wall portion 76 may taper, for example, from a maximum lateral width of approximately 0.25 inches to a minimum lateral width of approximately 0.15 inches.

In this way, the opposing side wall portions 76 define a forward opening 80 that has a lateral width that varies as the forward opening 80 extends in the forward direction along the central axis 62. For example, the lateral width of the forward opening 80 varies from a minimum width closest to a apex 74, to a maximum width farthest from the apex 74. The forward opening 80 may taper, for example, may taper, for example, from a minimum lateral width of approximately 0.4 inches to a maximum lateral width of approximately 0.65 inches.

In one aspect, the forward opening 80 has a lateral width that is larger than a lateral width of at least one of the side wall portions 76. In one example approach, the minimum lateral width of the forward opening 80 is approximately equal to a combined lateral width of the maximum lateral widths of the opposite side wall portions 76, and the maximum lateral width of the forward opening 80 is larger than a combined lateral width of the maximum lateral widths of the opposite side wall portions 76.

The rearward inclined wall portion 72 has a generally planar wall portion that includes an actuator hole 82. As discussed in greater detail elsewhere herein, the actuator hole 82 is sized to receive a user-actuatable actuator, such as a push-button.

The light module 50 further includes a light source 90 mounted at least partially within the housing interior 64. The light source 90 provides illumination outwardly from the housing 60; for example, through the forward opening 80. In one aspect, the light source 90 includes a single LED. In another aspect, the light source 90 includes a plurality of LEDs. A cover or lens 92 may extend across the LED portion of the light source 90.

The light module 50 also includes a switch device 100. The switch device 100 is electrically coupled to the light source 90 and the power source 52 for selectively energizing the light source 90. The switch device 100 includes, for example, a circuit board 102 and an actuator 110. The circuit board 102, which may be a printed circuit board (PCB) that includes electrical circuitry 106, is electrically coupled to the light source 90, as indicated at coupling 104.

The actuator 110 includes a plunger housing 112 that is secured to the circuit board 102. The actuator 110 further includes a plunger 114 that is movable within the plunger housing 112. The actuator 110 further includes a resilient button 116 that extends over the plunger 114. The resilient button 116 may have tactile indicia 118, such as one or both of a depression and a protrusion. In this way, the tactile indicia 118 may provide a user with tactile feedback indicating the user's finger has engaged the resilient button 116.

The light module 50 further includes a heat sink member 94. The heat sink member 94 is formed of, or includes, conductive material. More particularly, the heat sink member 94 is formed of a material with high thermal conductivity, such as an aluminum alloy. As such, the heat sink member 94 may have a thermal conductivity value of between about 120 W/mK to about 240 W/mK to conduct heat away from the light source 90 during operation of the light module 50. The heat conduction by the heat sink member 94 reduces the risk of damaging components of the light module 50 through overheating. In the illustrated and preferred form, the heat sink member 94 has a generally rectangular body. Although depicted as having a single heat sink member 94, the light module 50 may be provided with two or more heat sink members.

In the assembled configuration, the heat sink member 94 is electrically coupled to the circuit board 102, and the light source 90 is secured to a heat sink member 94. More particularly, the heat sink member 94 is disposed between the light source 90 and the circuit board 102 such that the light source 90 is separated from the circuit board 102 by the heat sink member 94. As shown, the heat sink member 94 may be installed in an inclined orientation. The inclination of the heat sink member 94 generally corresponds to that of the forward wall portion 70. In this way, the heat sink member 94 extends generally parallel to the forward wall portion 70.

The light module 50 further includes a reflector 130. The reflector 130 is a discrete reflector that is mounted (e.g., removably mounted) to the housing 60 within the housing interior 64. More particularly, the reflector 130 is mounted at the forward opening 80 of the housing 60.

The reflector 130 includes a rearward opening 132 that is aligned with the light source 90 to permit light emitted from the light source 90 to pass therethrough. The reflector 130 further includes a plurality of reflective walls that may extend generally forwardly and outwardly from the rearward opening 132 to the forward opening 80 (e.g., into engagement with the housing 60). As used herein, a generally forward direction may refer to the forward direction along axis 62, and a generally outward direction may refer to a direction generally away from a central axis of light source 90. As such, the light source 90 may emit light in a direction that is generally forward and generally downward from the light module 50.

Referring to FIGS. 3-6, the plurality of reflective walls includes, for example, a reflective upper wall 140. The reflective upper wall 140 may extend generally forwardly from the rearward opening 132. As such, light emitted through the forward opening 80 is reflected generally downwardly (e.g., away from the generally downwardly-facing surface of the brim portion 14 of FIGS. 1 and 2).

The plurality of reflective walls further includes one or more reflective side walls. For example, the reflector 130 includes a pair of opposing reflective side walls 142. The reflective upper wall 140 may extend between the opposing reflective side walls 142. The opposing reflective side walls 142 may taper away from each other as the opposing reflective side walls 142 extend away (e.g., generally downwardly) from the reflective upper wall 140. In one aspect, the reflective upper wall 140 extends away from the rearward opening 132 further than at least one, and preferably both, of the opposing reflective side walls 142. Furthermore, the opposing reflective side walls 142 may taper away from each other as the opposing reflective side walls 142 extend away (e.g., generally forwardly) from the rearward opening 132.

The plurality of reflective walls further includes a reflective lower wall 144. The reflective lower wall 144 may extend generally forwardly from the rearward opening 132. In one aspect, the opposing reflective side walls 142 extend away from the rearward opening further than the reflective lower wall 144. The reflective upper wall 140 may extend forwardly from the rearward opening 132 further than the opposing reflective side walls 142, the reflective lower wall 144, or both the reflective lower wall 144 and each opposing reflective side walls 142.

Referring again to FIGS. 3 and 4, the light module 50 further includes a backplate or mounting plate 150. The mounting plate 150 is securable to the housing 60, or vice versa. The mounting plate 150 may include a guide slot 152 that extends through the mounting plate 150; for example, through an entire thickness of the mounting plate 150. The guide slot 152 may extend from an outer periphery 154 (e.g., an outer peripheral edge) of the mounting plate 150 to a central region 156 of the mounting plate 150. The guide slot 152 is sized to receive an electrical connection therein (e.g., electrical connection 54 of FIGS. 1 and 2). As such, the electrical connection 54 may extend from the power source 52, through the guide slot 152 of the mounting plate 150, into the housing interior 64, and to the switch device 100.

One or more fasteners 160 are provided for securing housing 60 to the mounting plate 150. Similarly, one or more fasteners 162 are provided for securing the heat sink member 94 to the reflector 130. The fasteners 160 may be, for example, threaded fasteners, rivets, or the like.

Figure 7:
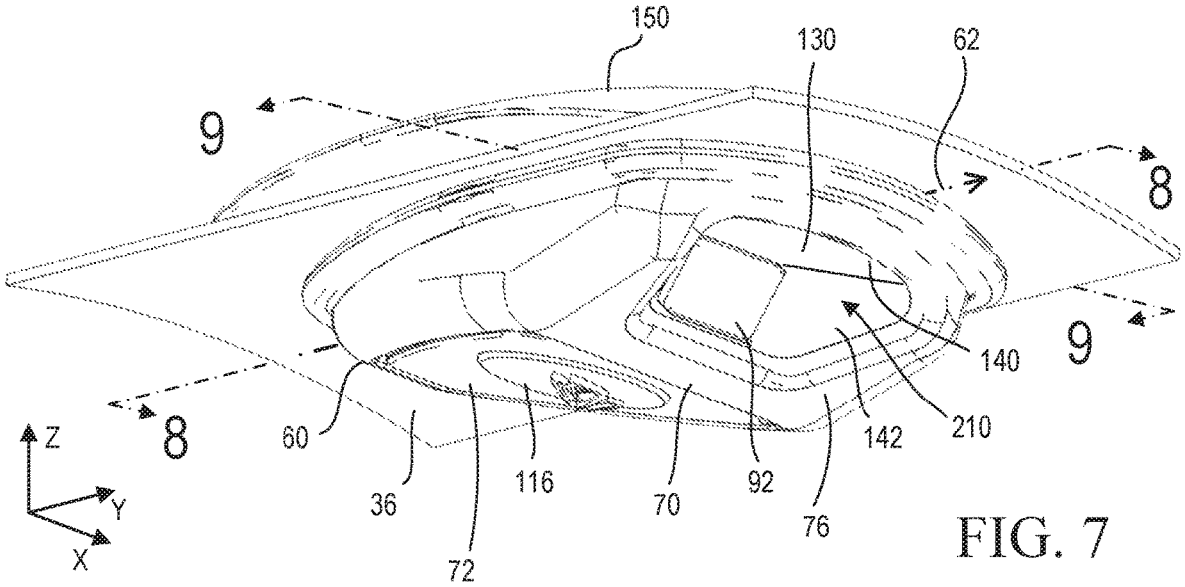
FIG. 7 is an enlarged perspective view of the light module of FIG. 1 showing a portion of the brim of the baseball-style lighted hat extending between the housing and the mounting plate of the light module.
Figure 8:
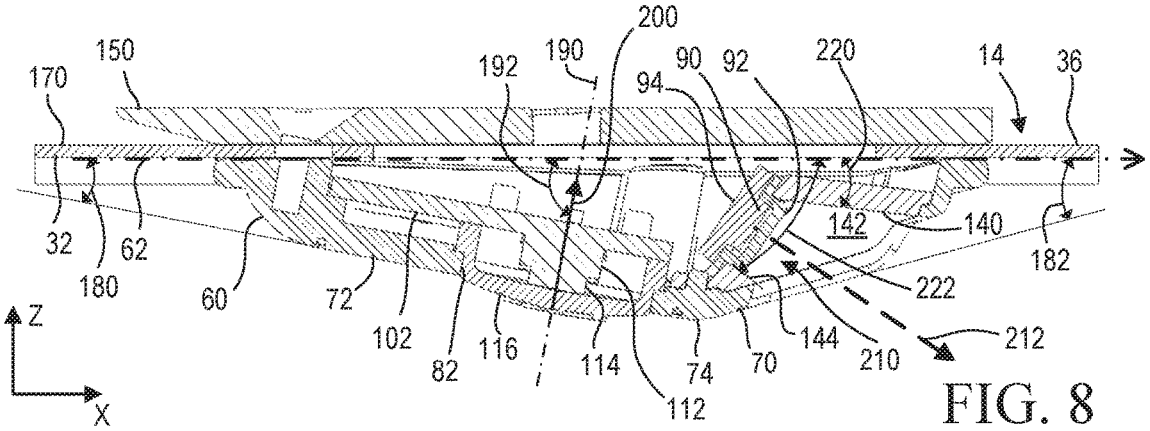
FIG. 8 is a cross-sectional view taken along the line 8-8 of FIG. 7 showing inclinations of various components of the light module.
Figure 9:
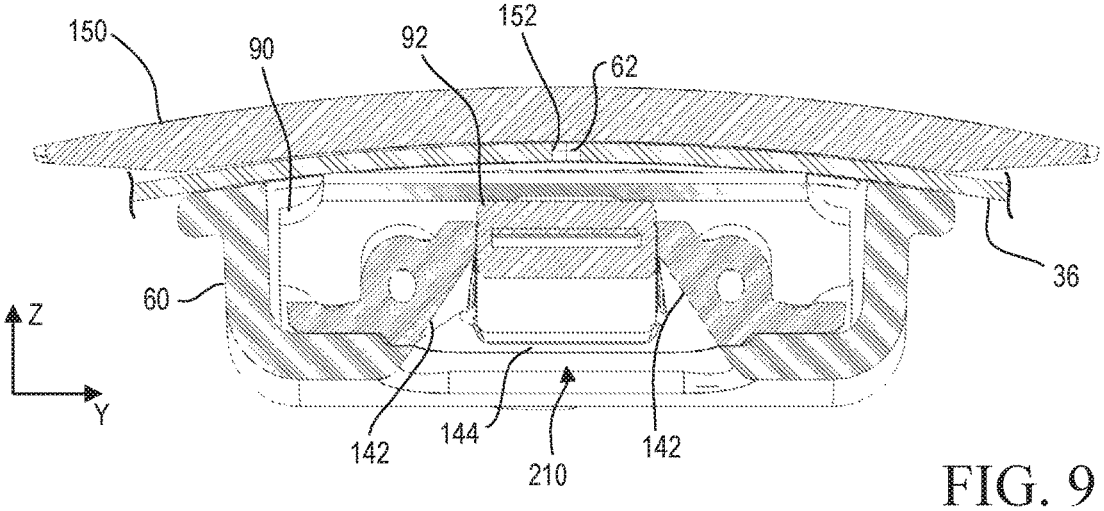
FIG. 9 is a cross-sectional view taken along the line 9-9 of FIG. 7 showing inclinations of various components of the light module.

Referring to FIGS. 7-9, in an assembled configuration, the mounting plate 150 is disposed at a brim-facing surface 170 of the lower covering 36, and the housing 60 is disposed at the lower major surface 32 of the lower covering 36 of the brim portion 14.

One or both of the rearward inclined wall portion 72 and the forward wall portion 70 may be inclined relative to the central axis 62. In one aspect, the rearward inclined wall portion 72 may extend at an oblique angle 180 relative to the central axis 62. The oblique angle 180 may be, for example, an acute angle in the range of approximately (e.g., +/−3 degrees) 5 degrees to approximately 40 degrees, and more particularly, is approximately 10 degrees. The forward wall portion 70 may also or may instead extend at an oblique angle 182 relative to the central axis 62.

The actuator 110 of the switch device 100 is associated with the rearward inclined wall portion 72. More particularly, the resilient button 116 of the actuator 110 is received in the actuator hole 82 of the rearward inclined wall portion 72. The actuator hole 82 includes a central hole axis 190 that intersects the central axis 62 at an oblique angle 192.

The actuator 110 is configured to travel in a linear actuation direction 200 when pushed by the user. During actuation, the resilient button 116 is deformed by the user to depress the plunger 114 in the linear actuation direction 200, which is arranged to be upwardly and forwardly relative to the generally downwardly-facing surface (e.g., lower major surface 32) of the brim portion 14 for ease of operation by the user.

In the depicted assembled configuration, the linear actuation direction 200 is orthogonal to the inclined circuit board 102. In one aspect, inclined circuit board 102 is mounted relative to the housing 60 (e.g., at least partially within the housing interior 64) such that the inclined circuit board 102 extends obliquely relative to the central axis 62.

The reflector 130 cooperates with the housing 60 to at least partially form a recessed light opening 210 of the light module 50. In the arrangement shown, the reflective upper wall 140 tapers downwardly away from the brim portion 14 as the reflective upper wall 140 extends generally forwardly from the rearward opening 132. The reflective lower wall 144 tapers downwardly away from the reflective upper wall 140 as the reflective lower wall 144 extends generally forwardly from the rearward opening 132.

In one approach, the reflective upper wall 140 tapers downwardly away from the brim portion 14 at a first oblique angle 220 as the reflective upper wall 140 extends generally forwardly from the rearward opening 132. The reflective lower wall tapers 144 downwardly away from the brim portion 14 at a second oblique angle 222 as the reflective lower wall 144 extends generally forwardly from the rearward opening 132. The second oblique angle 222 is different (e.g., greater) than the first oblique angle 220.

As such, the light source 90 is oriented to emit light in a direction 212 that is generally forwardly transverse to the linear actuation direction 200. The reflector 130 may act to prevent or inhibit light emitted from the light source 90 from casting on (and reflecting off of) the lower major surface 32 of the brim portion 14 (e.g., at the generally downwardly-facing surface of the brim portion 14). In this way, a field of view of a user that is generally forward and generally downward from the lighted hat 10 is illuminated, while glare in the user's line of sight is reduced or inhibited.

Figure 10:
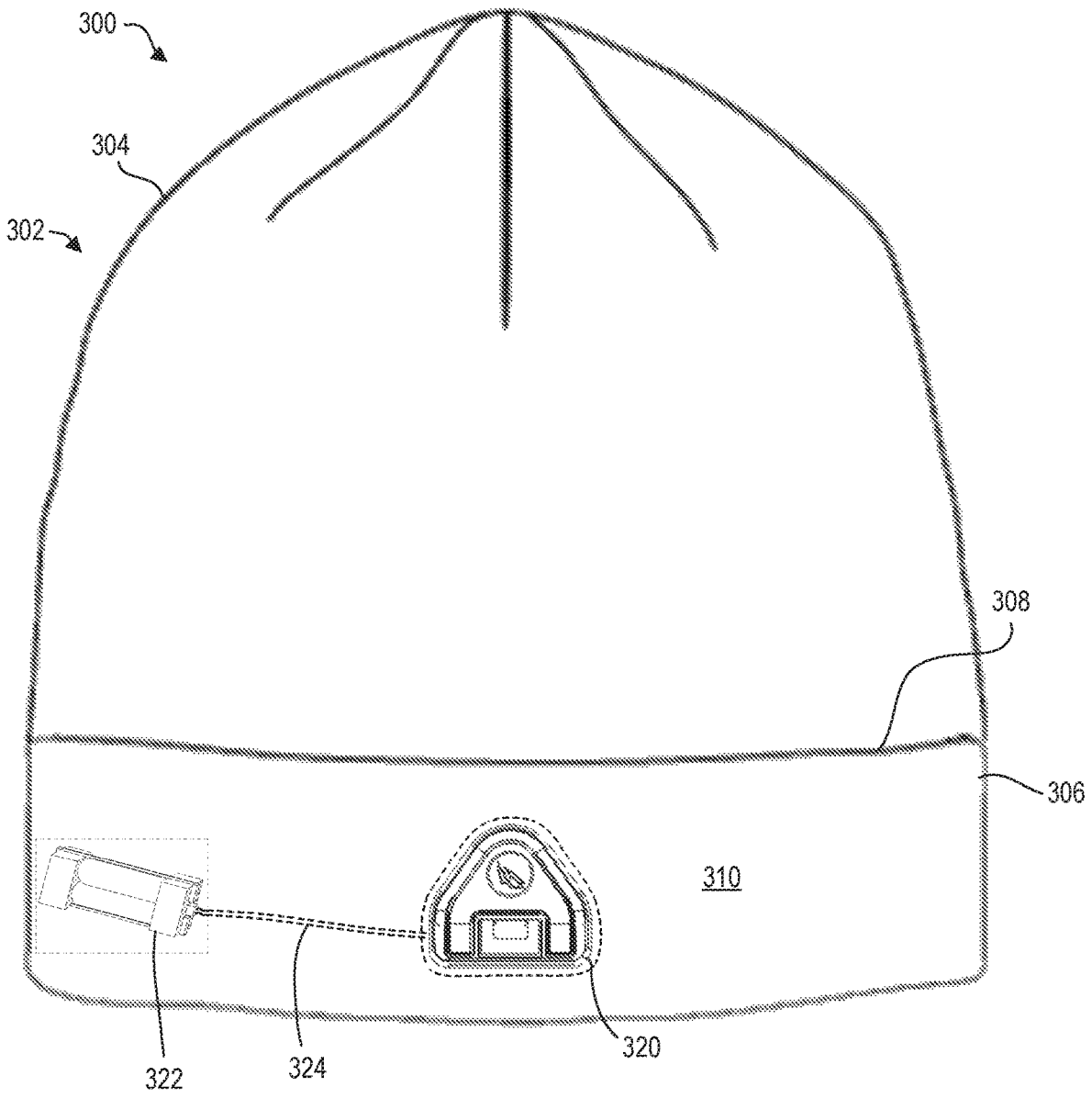
FIG. 10 is a front elevation view a beanie-style lighted cap having a battery pack and a light module to provide illumination generally forwardly.

Referring to FIG. 10, lighted headgear such as a lighted cap 300 is shown. The lighted cap 300 is in the form of a knit cap, which may be referred to as a beanie. The lighted cap 300 has a head fitting portion 302 for fitting on a head of a user. The head fitting portion 302 includes a crown portion 304, which may be referred to as a tapering portion, and an annular portion 306 that extends below the crown portion 304 when worn on a head of a user. The lighted cap 300 includes a cap band 308 disposed at a lower region of the annular portion 306 (e.g., inside of the lighted cap 300). The lighted cap 300, and more particularly, the cap band 308, includes a forwardly-facing surface 310 when worn.

The lighted cap 300 further includes a light module 320. The light module 320, discussed in greater detail with respect to FIGS. 11-17, is disposed at the cap band 308, and more particularly, at the forwardly-facing surface 310.

The lighted cap 300 further includes a power source 322, and an electrical connection 324 that spans between the power source 322 and the light module 320. The electrical connection 324 may include one or more wires to provide power to the light module 320. The power source 322, discussed in greater detail with respect to FIGS. 18-20, is illustrated as a battery pack that is stored in the cap band 308 of the annular portion 306 of the lighted cap 300.

Figure 11:
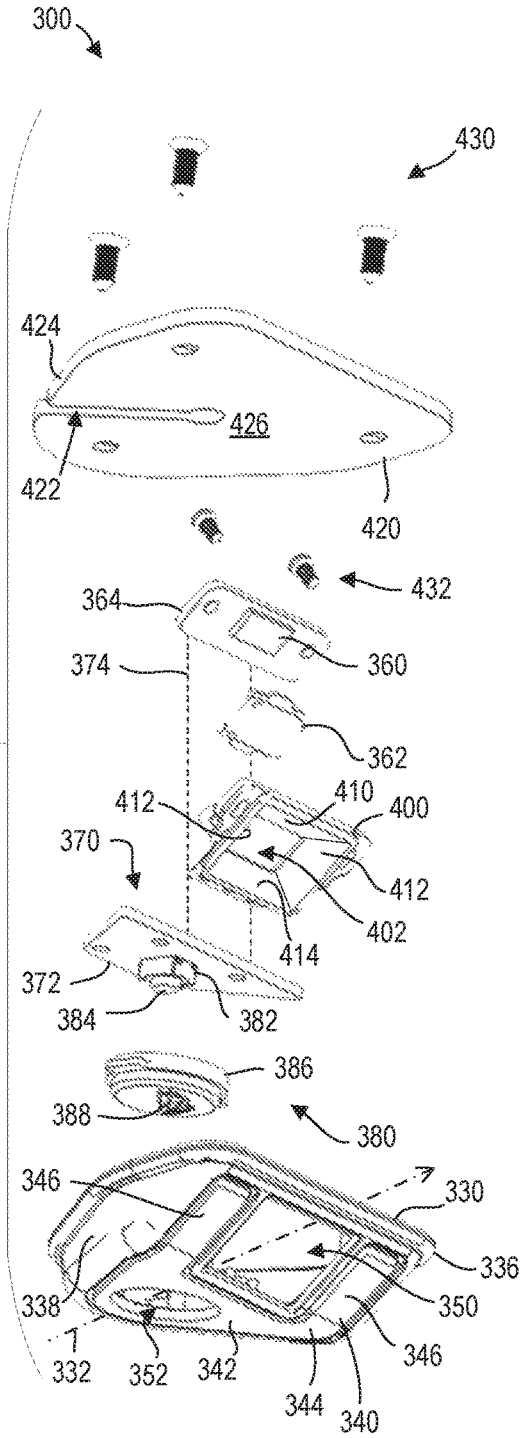
FIG. 11 is a lower perspective exploded view of the light module of FIG. 10 showing lower portions of various components of the light module.
Figure 12:
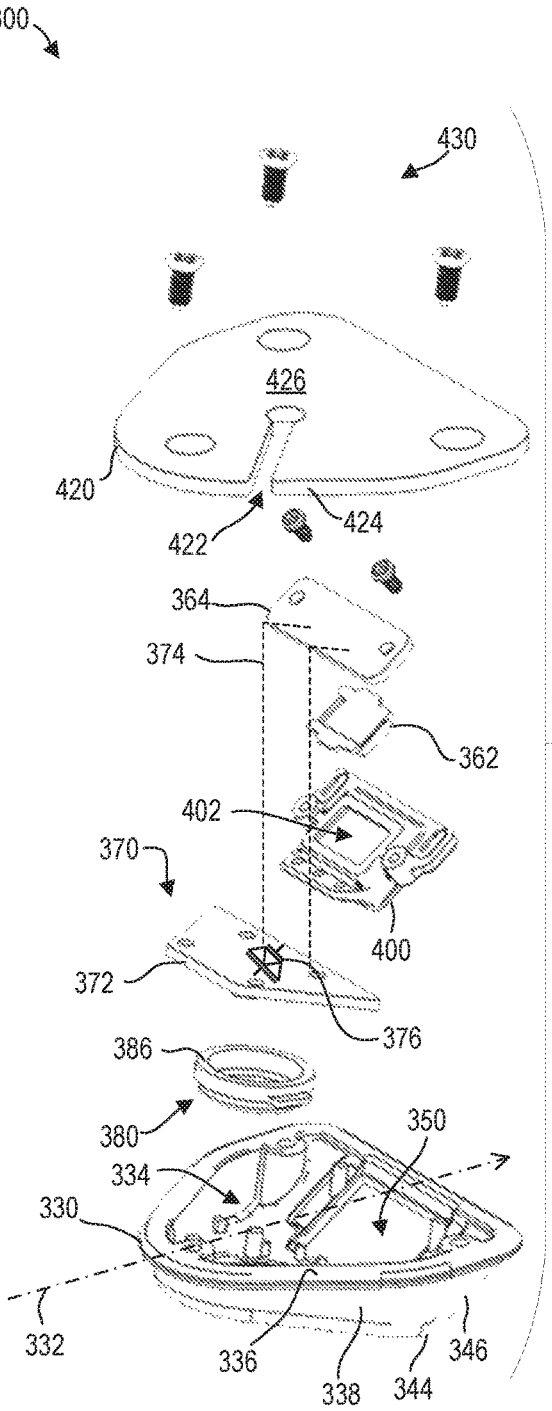
FIG. 12 is an upper perspective exploded view of the light module of FIG. 10 showing upper portions of various components of the light module.
Figure 13:
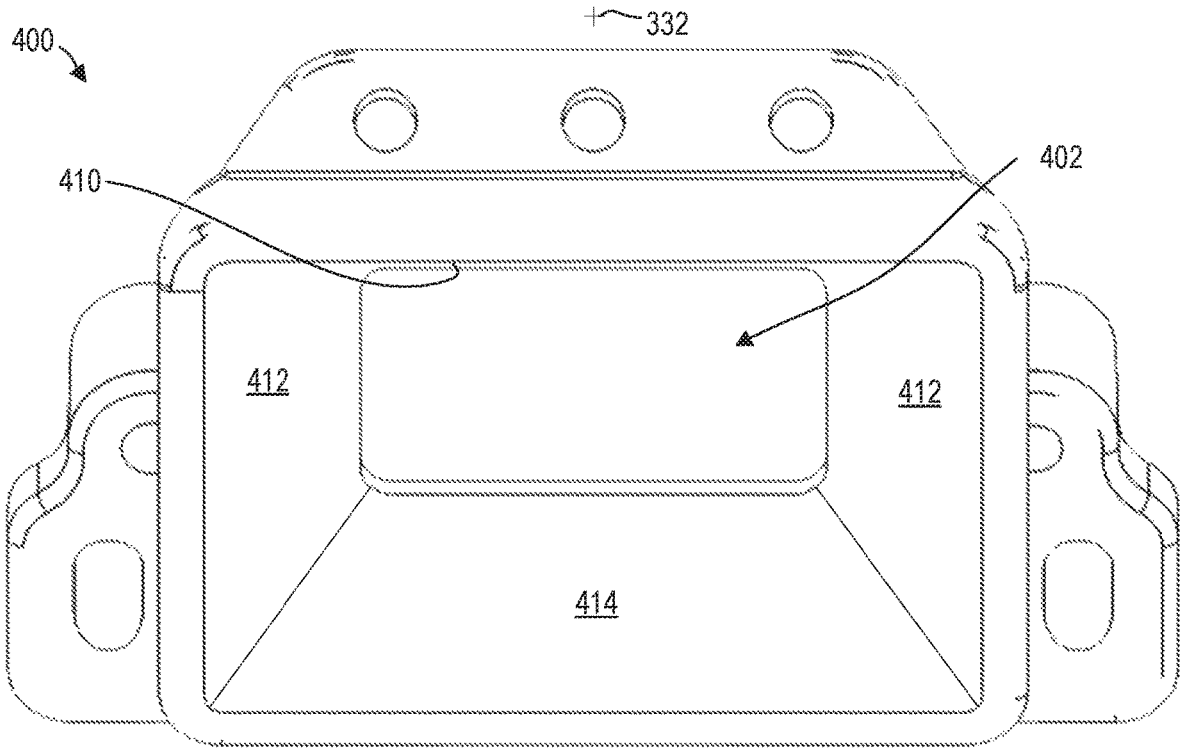
FIG. 13 is a front elevation view of the light module of FIG. 10 showing reflector walls extending from a rearward opening of the reflector.
Figure 14:
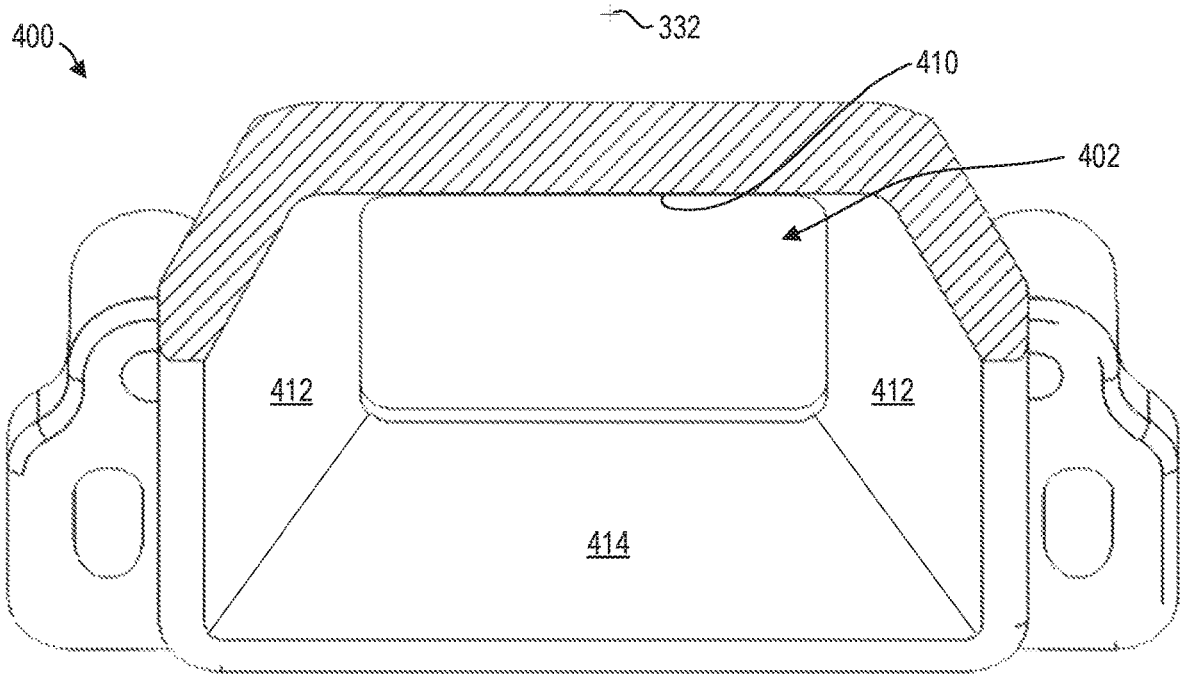
FIG. 14 is a cross-sectional view of FIG. 13 showing the inclination of the opposing reflective side walls relative to the reflective upper wall.

Referring to FIGS. 11 and 12, the light module 320 includes a housing 330. The housing 330 has a central axis 332 that extends in a generally forward direction. The central axis 332 extends, for example, through or along a base flange 336 of the housing 330.

The housing 330 includes housing walls that extend from the base flange 336, and extend about a housing interior 334. The housing walls may generally define a wedge-shaped housing. In this regard, the housing walls include a lower wall portion 340, an upper wall portion 342, and opposing side walls 338 that extend between the base flange 336 and the lower wall portion 340 and upper wall portion 342. In one approach, a side wall 338 has a rearward side wall portion that forms a rearward curved or rounded side interface with the upper wall portion 342, and a forward side wall portion that forms a forward curved or rounded side interface with the lower wall portion 340.

The lower wall portion 340 and the upper wall portion 342 converge to form an apex 344 of the housing 330. In one aspect, the apex 344 is a curved or rounded apex.

The lower wall portion 340 includes one or more opposite sections, referred to herein as side wall portions 346, that at least partially define an opening. For example, two opposing side wall portions 346 cooperate to at least partially form a lower opening 350, also referred to herein as a large light opening, therebetween.

The lower opening 350 has a lateral width (e.g., in a direction orthogonal to the central axis 332) that is larger than a lateral width of at least one of the side wall portions 346. In one aspect, the lateral width of the lower opening 350 is larger than the lateral width of one of the opposite side wall portions 346, but smaller than a combined lateral width of the lateral widths of both of the opposite side wall portions 346. For example, each side wall portion 346 may have a lateral width of approximately 0.27 inches such that the side wall portions 346 have a combined lateral width of approximately 0.54 inches, and the lower opening 350 may have a lateral width of approximately 0.53 inches.

In still another aspect, the lateral width of the lower opening 350 is larger than a combined lateral width of the lateral widths of both of the opposite side wall portions 346. For example, each side wall portion 346 may have a lateral width of approximately 0.25 inches such that the side wall portions 346 have a combined lateral width of approximately 0.5 inches, and the lower opening 350 may have a lateral width of approximately 0.53 inches.

The upper wall portion 342 has a generally planar wall portion that includes an actuator hole 352. As discussed in greater detail elsewhere herein, the actuator hole 352 is sized to receive a user-actuatable actuator, such as a push-button. In the approach shown, the lower wall portion 340 is a lower inclined wall portion, and the upper wall portion 342 is an upper inclined wall portion.

The light module 320 further includes a light source 360 that is mounted at least partially within the housing interior 334. The light source 360 may provide illumination outwardly from the housing 330; for example, through the lower opening 350. In one aspect, the light source 360 includes a single LED. In another aspect, the light source 360 includes a plurality of LEDs. A cover or lens 362 may extend across the LED portion of the light source 360.

The light module 320 also includes a switch device 370. The switch device 370 is electrically coupled to the light source 360 and the power source 322 for selectively energizing the light source 360. The switch device 370 includes, for example, a circuit board 372 and an actuator 380. The circuit board 372, which may be a printed circuit board (PCB) that includes electrical circuitry 376, is electrically coupled to the light source 360, as indicated at coupling 374.

The actuator 380 includes a plunger housing 382 that is secured to the circuit board 372. The actuator 380 further includes a plunger 384 that is movable within the plunger housing 382. The actuator 380 further includes a resilient button 386 that extends over the plunger 384. The resilient button 386 may have tactile indicia 388, such as one or both of a depression and a protrusion. In this way, the tactile indicia 388 may provide a user with tactile feedback indicating the user's finger has engaged the resilient button 386.

The light module 320 further includes a heat sink member 364. The heat sink member 364 is formed of, or includes, conductive material. More particularly, the heat sink member 364 is formed of a material with high thermal conductivity, such as an aluminum alloy. As such, the heat sink member 364 may have a thermal conductivity value of between about 120 W/mK to about 240 W/mK to conduct heat away from the light source 360 during operation of the light module 320. The heat conduction by the heat sink member 364 reduces the risk of damaging components of the light module 320 through overheating. In the illustrated and preferred form, the heat sink member 364 has a generally rectangular body. Although depicted as having a single heat sink member 364, the light module 320 may be provided with two or more heat sink members.

In the assembled configuration, the heat sink member 364 is electrically coupled to the circuit board 372, and the light source 360 is secured to a heat sink member 364. More particularly, the heat sink member 364 is disposed between the light source 360 and the circuit board 372 such that the light source 360 is separated from the circuit board 372 by the heat sink member 364. As shown, the heat sink member 364 may be installed in an inclined orientation. The inclination of the heat sink member 364 generally corresponds to that of the lower wall portion 340. In this way, the heat sink member 364 extends generally parallel to the lower wall portion 340.

The light module 320 further includes a reflector 400. The reflector 400 is a discrete reflector that is mounted (e.g., removably mounted) to the housing 330 within the housing interior 334. More particularly, the reflector 400 is mounted at the lower opening 350 of the housing 330. The reflector 400 includes a rearward opening 402 that is aligned with the light source 360 to permit light emitted from the light source 360 to pass therethrough. The reflector 400 includes a plurality of reflective walls that may extend generally forwardly and outwardly from the rearward opening 402 to the lower opening 350 (e.g., into engagement with the housing 330). As used herein, a generally forward direction may refer to the forward direction along axis 332, and a generally outward direction may refer to a direction generally away from a central axis of light source 360. As such, the light source 360 may emit light in a direction that is generally forward and generally downward from the light module 320.

Referring to FIGS. 11-14, the plurality of reflective walls include, for example, a reflective upper wall 410. The reflective upper wall 410 may extend generally forwardly from the rearward opening 402. As such, light emitted through the lower opening 350 is reflected generally downwardly and/or generally forwardly.

The plurality of reflective walls further includes one or more reflective side walls. For example, the reflector 400 includes a pair of opposing reflective side walls 412. The reflective upper wall 410 may extend between the opposing reflective side walls 412. The opposing reflective side walls 412 may taper away from each other as the opposing reflective side walls 412 extend away from the rearward opening 402. In one aspect, the reflective upper wall 410 and each of the opposing reflective side walls 412 extend equidistant from the rearward opening 402 to the lower opening 350.

The plurality of reflective walls further includes a reflective lower wall 414. The reflective lower wall 414 may extend generally forwardly from the rearward opening 402 to the lower opening 350. In one aspect, the reflective lower wall 414 and the reflective upper wall 410 extend equidistant from the rearward opening 402 to the lower opening 350. In another aspect, the reflective upper wall 410 extends a greater distance from the rearward opening 402 to the lower opening 350.

Referring again to FIGS. 11 and 12, the light module 320 further includes a backplate or mounting plate 420. The mounting plate 420 is securable to the housing 330, or vice versa. The mounting plate 420 may include a guide slot 422 that extends through the mounting plate 420; for example, through an entire thickness of the mounting plate 420. The guide slot 422 may extend from an outer periphery 424 (e.g., an outer peripheral edge) of the mounting plate 420 to a central region 426 of the mounting plate 420. The guide slot 422 is sized to receive an electrical connection therein (e.g., electrical connection 324 of FIG. 10). As such, the electrical connection 324 may extend from the power source 322, through the guide slot 422 of the mounting plate 420, into the housing interior 334, and to the switch device 370.

One or more fasteners 430 are provided for securing housing 330 to the mounting plate 420. Similarly, one or more fasteners 432 are provided for securing the heat sink member 364 to the reflector 400. The fasteners 430 may be, for example, threaded fasteners, rivets, or the like.

Figure 15:
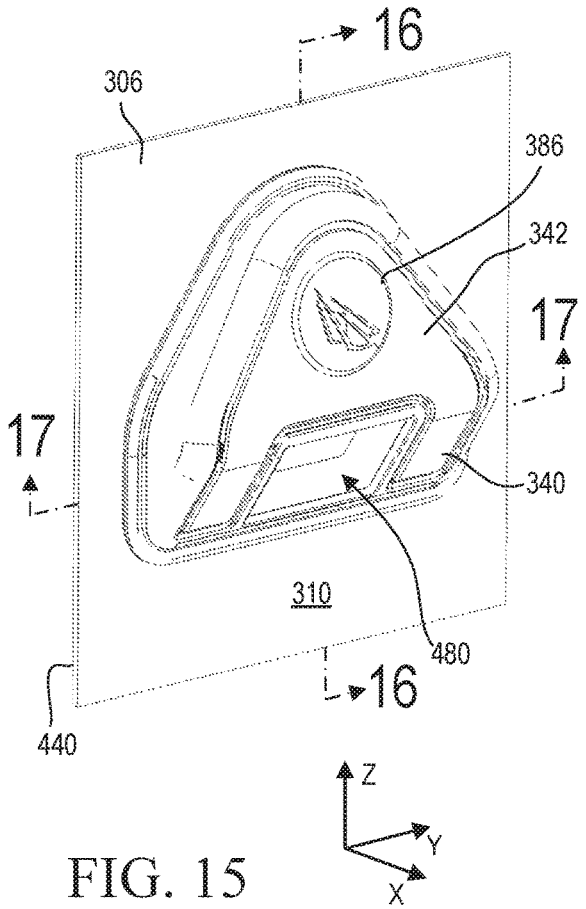
FIG. 15 is an enlarged perspective view of the light module of FIG. 10 showing a portion of the beanie-style lighted cap extending between the housing and the mounting plate of the light module.
Figure 16:
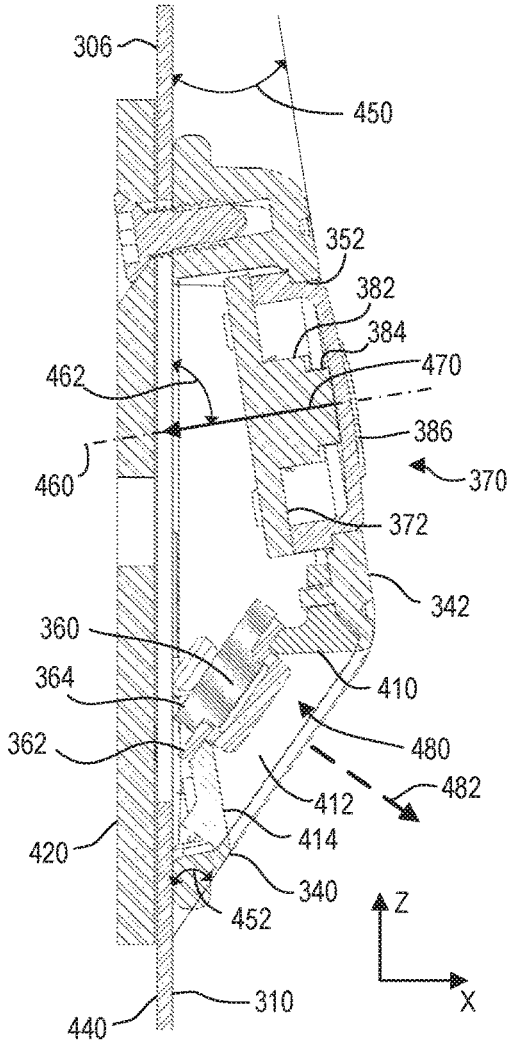
FIG. 16 is a cross-sectional view taken along the line 16-16 of FIG. 15 showing inclinations of various components of the light module.
Figure 17:
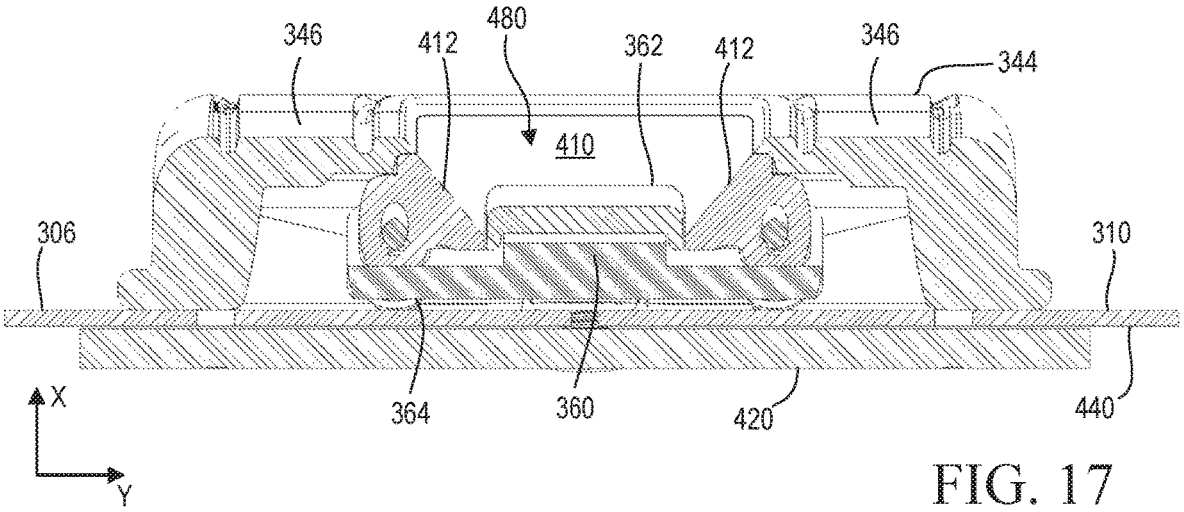
FIG. 17 is a cross-sectional view taken along the line 17-17 of FIG. 15 showing inclinations of various components of the light module.

Referring to FIGS. 15-17, in an assembled configuration, the mounting plate 420 is disposed at a rearward-facing surface 440 of the annular portion 306 (e.g., at the cap band 308), and the housing 330 is disposed at the forwardly-facing surface 310 of the cap band 308. The housing 330 is secured to the mounting plate 420 such that at least a portion of the head-fitting portion (e.g., annular portion 306) extends between and in engagement with the mounting plate 420 and the housing 330.

One or both of the upper wall portion 342 and the lower wall portion 340 may be inclined relative to the central axis 332. In one aspect, the upper wall portion 342 extends at an oblique angle 450 relative to the cap band 308 (e.g., relative to the forwardly-facing surface 310 of the cap band 308) such that the upper wall portion 342 tapers away from the forwardly-facing surface 310 as the upper wall portion 342 extends downwardly (e.g., along the Z axis of FIG. 16). The oblique angle 180 may be, for example, an acute angle in the range of approximately (e.g., +/−3 degrees) 5 degrees to approximately 45 degrees, and more particularly, is approximately 10 degrees.

The lower wall portion 340 may also or may instead extend at an oblique angle 452 relative to the cap band 308 (e.g., relative to the forwardly-facing surface 310 of the cap band 308). In this way, the lower wall portion 340 includes a lower inclined wall portion inclined obliquely relative to the forwardly-facing surface 310 to taper toward the forwardly-facing surface 310 as the lower inclined wall portion extends downwardly (e.g., along the Z axis of FIG. 16).

The actuator 380 of the switch device 370 is associated with the upper wall portion 342. More particularly, the resilient button 386 of the actuator 380 is received in the actuator hole 352 of the upper wall portion 342. The actuator hole 352 includes a central hole axis 460 that intersects the forwardly-facing surface 310 of the cap band 308 at an oblique angle 462.

The actuator 380 is configured to travel in a linear actuation direction 470 when pushed by the user. During actuation, the resilient button 386 is deformed by the user to depress the plunger 384 in the linear actuation direction 470, which is arranged to be downwardly and rearwardly relative to the generally forwardly-facing surface 310 of the cap band 308 for ease of operation by the user.

The reflector 400 cooperates with the housing 330 to at least partially form a recessed light opening 480 of the light module 320. As such, light emitted from the light source 360 is oriented in a direction 482 that is generally forward and downward from the light module 320. In this way, an area that is forward and generally downward from the lighted hat 10 is illuminated.

Referring to FIGS. 18-22, a battery holder 500 is shown. The battery holder 500 may be used for the power source 52 of FIGS. 1 and 2, and/or the power source 322 of FIG. 10.

The battery holder 500 includes a frame assembly 502 that includes a first end cover 504 and a second end cover 506. The first end cover 504 includes a first battery contact element 510 that includes a first pair of battery contact elements. In one aspect, the first battery contact element 510 is a unitary conversion plate (e.g., a positive-negative conversion spring contact plate). In another aspect, the first battery contact element 510 includes discrete positive and negative contacts.

Similarly, the second end cover 506 includes a second battery contact element 512 that includes a second pair of battery contact elements. In one aspect, the second battery contact element 512 is a unitary conversion plate (e.g., a positive-negative conversion spring contact plate). In another aspect, the second battery contact element 512 includes discrete positive and negative contacts.

The battery holder 500 includes a wiring hub 520 that extends from the frame assembly 502; for example, from a lower region of the first end cover 504. The wiring hub 520 may guide an electrical connection 522 extending from the frame assembly 502. The electrical connection may generally correspond to the electrical connection 54 of FIGS. 1 and 2 and/or the electrical connection 324 of FIG. 10.

Figure 22:
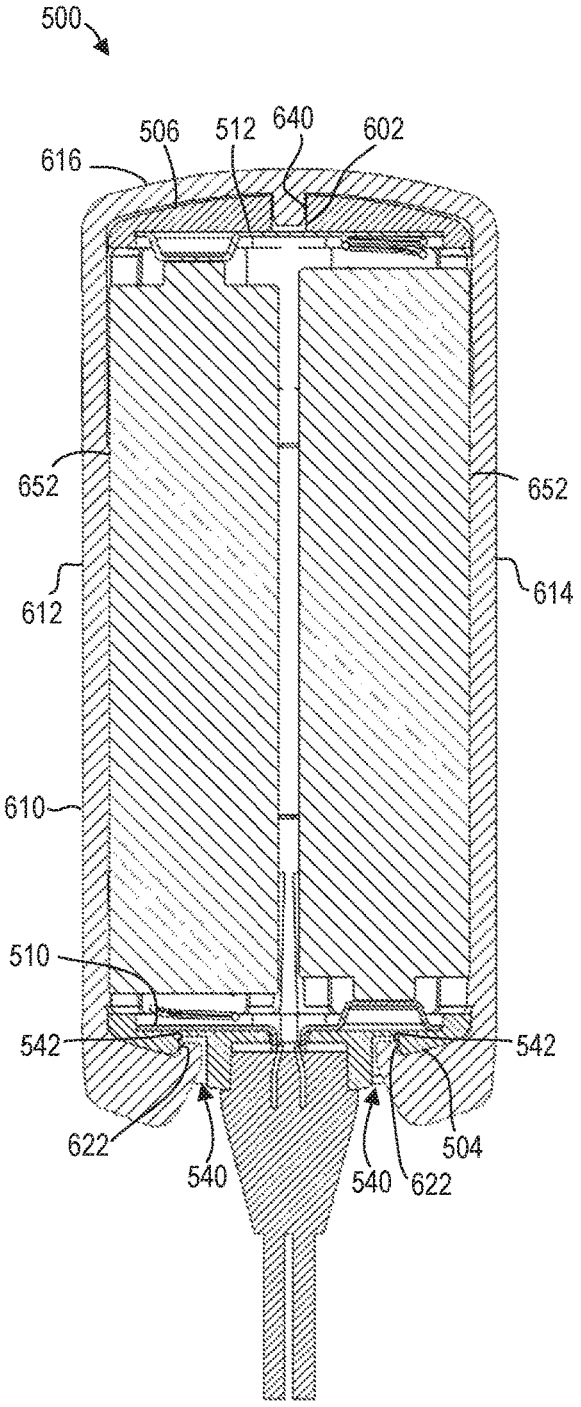
FIG. 22 is a cross-sectional view of the reflector of FIG. 18 in an assembled configuration.

As shown in FIGS. 19 and 22, the first end cover 504 includes laterally-extending channels 530 extending along an end surface 532 of the first end cover 504. The laterally-extending channels 530 are defined by at least laterally-extending sidewalls of the first end cover 504. More particularly, in the approach shown, the laterally-extending channels 530 are defined by laterally-extending sidewalls and a laterally-extending upper wall.

A laterally-extending channel 530 includes a recess 540. For example, the two recesses shown in FIG. 19 may extend longitudinally from the end surface 532 a greater distance than the laterally-extending sidewalls of the laterally-extending channel 530. In this way, each recess 540 defines an abutment surface 542, which may be a side wall of a recess 540. In one aspect, the wiring hub 520 extends from the end surface 532 of the first end cover 504 between the recesses 540.

Referring to FIG. 20, the first end cover 504 further includes longitudinally-extending channels 550. The longitudinally-extending channels 550 may extend from the laterally-extending channels 530 at side end portions 552 of the first end cover 504. A longitudinally-extending channel 550 is defined between side prongs 554 that extend longitudinally from a base portion 556 of the first end cover 504. A longitudinally-extending channel 550 is contiguous with a corresponding laterally-extending channel 530 to define a contiguous side channel in the first end cover 504.

The side prongs 554 include generally curved interior surfaces that face in the general direction of a central axis 560 of the battery holder 500. The generally curved interior surfaces are dimensioned to interface (e.g., retain or secure) a cylindrical battery.

The first end cover 504 further includes intermediate prongs 570 that extend longitudinally from the base portion 556 of the first end cover 504 between corresponding side prongs 554. The intermediate prongs 570 include generally curved interior surfaces that face in the general direction the generally curved interior surfaces of the side prongs 554. The intermediate prongs 570 cooperate with a first set of side prongs 554 at one side of the first end cover 504 to form a first portion of a battery lower compartment therebetween, and cooperate with a second set of side prongs 554 at an opposite side of the first end cover 504 to form a second portion of the lower battery compartment therebetween.

The second end cover 506 includes a laterally-extending channel 580 extending along an end surface 582 of the second end cover 506. In one aspect, the laterally extending channel 580 extends along an entire lateral length of the end surface 582. The second end cover 506 further includes longitudinally-extending channels 590. The longitudinally-extending channels 590 may extend from the laterally-extending channel 580 at side end portions 592 of the second end cover 506. A longitudinally-extending channel 550 is defined between side prongs 594 that extend longitudinally from a base portion 596 of the second end cover 506. A longitudinally-extending channel 590 is contiguous with the laterally-extending channel 580 to define a contiguous side channel in the second end cover 506.

The side prongs 594 include generally curved interior surfaces that face in the general direction of the central axis 560 of the battery holder 500. The generally curved interior surfaces is dimensioned to interface (e.g., retain or secure) a cylindrical battery.

The second end cover 506 further includes intermediate prongs 600 that extend longitudinally from the base portion 596 of the second end cover 506 between corresponding side prongs 594. The intermediate prongs 600 include generally curved interior surfaces that face in the general direction the generally curved interior surfaces of the side prongs 594. The intermediate prongs 600 may cooperate with a first set of side prongs 594 at one side of the second end cover 506 to form a first portion of an upper battery compartment therebetween, and may cooperate with a second set of side prongs 594 at an opposite side of the second end cover 506 to form a second portion of the upper battery compartment therebetween.

The second end cover 506 further includes a hole 602. The hole 602 may be a through-hole or a blind hole that is disposed in the base portion 596 of the second end cover 506; for example, within the laterally-extending channel 580.

The battery holder 500 includes a resilient clip member 610. The resilient clip member 610 may be a component of the frame assembly 502. In one aspect, the resilient clip member 610 is a detachable resilient clip member. As shown, the resilient clip member 610 has a generally U-shaped configuration. In another aspect, the resilient clip member 610 is an integrally-formed resilient clip member that is integrally formed, for example, with the first end cover 504 or the second end cover 506.

The resilient clip member 610 includes a first resilient arm 612, a second resilient arm 614, and a base portion 616 that extends between the first resilient arm 612 and the second resilient arm 614 to interconnect the first resilient arm 612 and the second resilient arm 614. The first resilient arm 612 is an elongated arm that extends from the base portion 616 to a first free end portion 620. The first free end portion 620 includes a first latching hook 622. The first latching hook 622 may extend from the first free end portion 620 in the general direction of the base portion 616. Additionally or alternatively, the first free end portion 620 includes a first release tab 624. The first release tab 624 extends from the first free end portion 620 in a direction generally opposite the base portion 616 (e.g., opposite the first latching hook 622). The first release tab 624 may assist a user in manipulating the first resilient arm 612 (e.g., from an assembled or latched configuration to an unassembled or unlatch configuration).

Similarly, the second resilient arm 614 is an elongated arm that extends from the base portion 616 to a second free end portion 630. The second free end portion 630 includes a second latching hook 632. The second latching hook 622 extends from the second free end portion 630 in the general direction of the base portion 616. Additionally or alternatively, the second free end portion 630 includes a second release tab 634. The second release tab 634 extends from the second free end portion 630 in a direction generally opposite the base portion 616 (e.g., opposite the second latching hook 632). The second release tab 634 may assist a user in manipulating the second resilient arm 614 (e.g., from an assembled or latched configuration to an unassembled or unlatch configuration).

The resilient clip member 610 further includes a guide peg 640. The guide peg 640 is provided, for example, at an interior surface of the base portion 616. The guide peg 640 is dimensioned to be received within the hole 602 of the second end cover 506. In this way, the guide peg 640 and the hole 602 may cooperate to assist a user in aligning the resilient clip member 610 with the second end cover 506. In another aspect, the second end cover 506 is provided with a guide peg, and the resilient clip member 610 is provided with a hole to assist a user in aligning the resilient clip member 610 with the second end cover 506.

The battery holder 500 is depicted in an unassembled configuration in FIGS. 18-20. In the unassembled configuration, one or both of the first free end portion 620 and the second free end portion 630 are disengaged from the first end cover 504. Also in the unassembled configuration, the first and second resilient arms 612, 614 are outwardly divergent. That is, the first and second resilient arms 612, 614 taper away from each as they extend along the central axis 560 away from the base portion 616.

Figure 21:
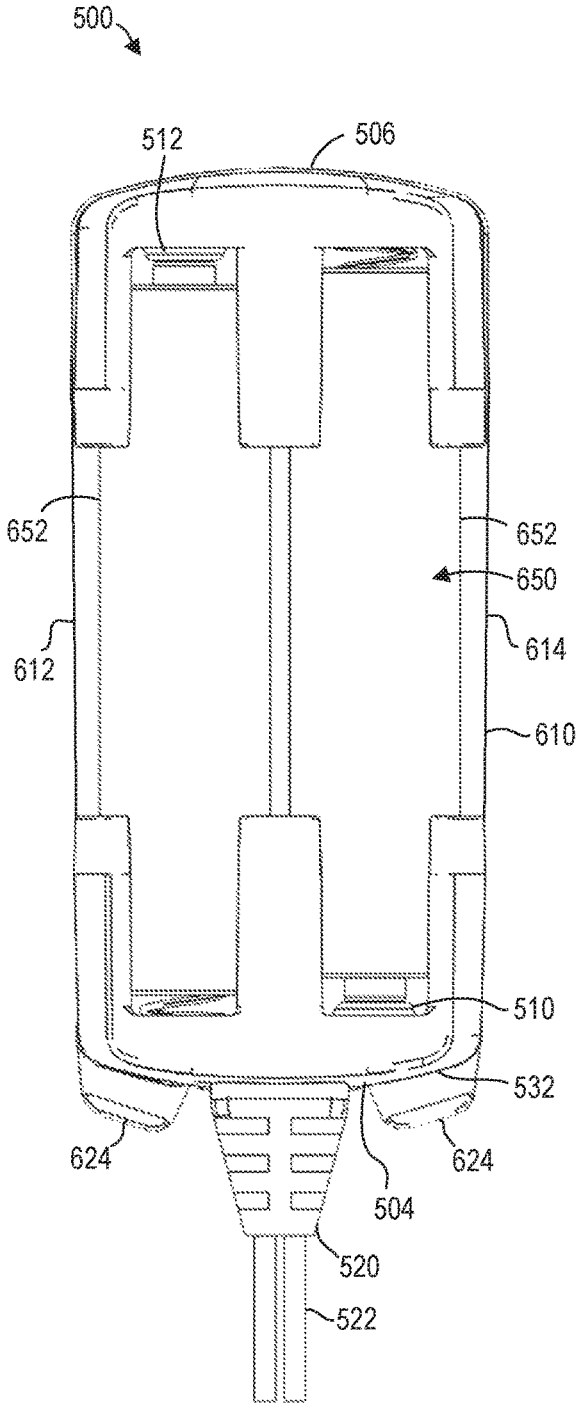
FIG. 21 is a front elevation view of the battery holder of FIG. 18 in an assembled configuration.

Referring to FIGS. 21 and 22, the battery holder 500 is depicted in an assembled configuration. In the assembled configuration, the first and second resilient arms 612, 614 extend from the second end cover 506 to the first end cover 504 such that the free end portions 620, 630 engage the first end cover 504 to releasably secure the second end cover 506 to the first end cover 504. Also in the assembled configuration, the first end cover 504, the second end cover 506, and the first and second resilient arms 612, 614 cooperate to define at least one substantially open battery compartment 650. In one aspect, the battery compartment 650 is dimensioned to receive a single battery 652. In another aspect, the battery compartment 650 is dimensioned to receive a plurality of batteries, such as two batteries 652. The one or more batteries 652 may be cylindrical batteries disposed longitudinally between the first and second battery contact elements 510, 512 and laterally between the first and second resilient arms 612, 614.

Also in the assembled configuration, the base portion 616 is at least partially received within the laterally-extending channel 580 of the second end cover 506. In one aspect, the base portion 616 is received within the laterally-extending channel 580 such that an outwardly-facing surface of the base portion 616 is flush, or substantially flush, with an outwardly-facing surface of the end surface 582 of the second end cover 506. Furthermore, the first and second resilient arms 612, 614 are at least partially received within the longitudinally-extending channels 590 of the second end cover 506. In one aspect, the first and second resilient arms 612, 614 are received within the longitudinally-extending channels 590 such that outwardly-facing surfaces of the first and second resilient arms 612, 614 are flush, or substantially flush, with outwardly-facing surfaces of side end portions 592 of the second end cover 506.

The first and second resilient arms 612, 614 extend longitudinally along the battery compartment 650 (including along batteries 652, if installed) toward the first end cover 504. The first and second resilient arms 612, 614 are at least partially received within the longitudinally-extending channels 550 of the first end cover 504. In one aspect, the first and second resilient arms 612, 614 are received within the longitudinally-extending channels 550 such that outwardly-facing surfaces of the first and second resilient arms 612, 614 are flush, or substantially flush, with outwardly-facing surfaces of side end portions 552 of the first end cover 504. As such, in the assembled configuration, the first and second resilient arms 612, 614 are generally parallel. The free end portions 620, 630 are at least partially received within the laterally-extending channels 530 that extend along the end surface 532 of the first end cover 504.

The first and second latching hooks 622, 632 are adapted to secure the second end cover 506 to the first end cover 504 via the first and second resilient arms 612, 614. More particularly, the first and second latching hooks 622, 632 extend into the recesses 540 of the first end cover 504 and into engagement with the abutment surfaces 542 formed in the recesses 540. Upon engagement, lateral movement of the free end portions 620, 630 (e.g., in a direction substantially orthogonal to the central axis 560) is substantially inhibited. Furthermore, one or both of the first and second battery contact elements 510, 512 includes a spring that imparts a longitudinally-biasing force through the one or more batteries 652 that biases the first and second end covers 504, 506 in opposite directions. Such opposing longitudinally-biasing forces act to retain the free end portions 620, 630 of the first and second resilient arms 612, 614 within the laterally-extending channels 530 of the first end cover 504.

As such, in the assembled configuration, the free end portions 620, 630 of the first and second resilient arms 612, 614 engage the abutment surfaces 542 to releasably secure the second end cover 506 to the first end cover 504. The resilient clip member 610 interfaces the various laterally-extending and longitudinally-extending channels of the first and second end covers 504, 506 to provide a low profile battery holder 500.

In the approach shown, the battery holder 500 includes first and second substantially open side-by-side compartments that are sized and shaped to fixedly retain first and second cylindrical-shaped batteries 652. The first and second end covers 504, 506 are disposed opposite to each other and spaced apart at the opposite ends of the frame assembly 502 such that the first and second batteries 652 are securely engaged with corresponding ones of the contact elements and are not fully enclosed by the frame assembly 502.

As discussed, the free end portions 620, 630 are provided with release tabs 624, 634 to assist a user in manipulating the first and second resilient arms 612, 614 (e.g., from the assembled or latched configuration to an unassembled or unlatch configuration). In this way, the resilient clip member 610 is configured to releasably connect the first and second end covers 504, 506 together to form the frame assembly 502, and to allow the first and second end covers 504, 506 covers to be disconnected from each other for removal and replacement of the batteries 652.

Although depicted as a discrete, detachable resilient clip member 610, one or more portions of the resilient clip member 610 may be integrated with first end cover 504, the second end cover 506, or a combination of the first end cover 504 and the second end cover 506. For example, the resilient clip member 610 may be integrally formed with the second end cover 506 such that the second end cover 506 includes integrally-formed elongated resilient arms.

While exemplary embodiments are described above, it is not intended that these embodiments describe all possible forms encompassed by the claims. The words used in the specification are words of description rather than limitation, and it is understood that various changes is made without departing from the spirit and scope of the disclosure. As previously described, the features of various embodiments is combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics is compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and is desirable for particular applications.

What is claimed is:

1. Lighted headgear comprising:

a head fitting portion for fitting on a head of a user;

a brim portion that extends in a generally forward direction from the head fitting portion, the brim portion having a generally downwardly-facing surface and including a central axis that extends in the generally forward direction; and a light module mounted to the generally downwardly-facing surface of the brim portion, the light module including:

a housing having a forward wall portion that includes a forward opening, and a rearward inclined wall portion that extends obliquely relative to the central axis, a light source mounted in the housing to direct light through the forward opening, and a switch device electrically coupled to the light source for selectively energizing the light source, the switch device having an actuator associated with the rearward inclined wall portion and being configured to travel in a linear actuation direction when pushed by the user, the linear actuation direction being arranged to be upwardly and forwardly relative to the generally downwardly-facing surface of the brim portion for ease of operation by the user.

2. The lighted headgear of claim 1 wherein the switch device includes an inclined circuit board that is mounted in the housing to extend obliquely relative to the central axis, the inclined circuit board being electrically coupled to the light source and the switch device.

3. The lighted headgear of claim 2 wherein the linear actuation direction is orthogonal to the inclined circuit board.

4. The lighted headgear of claim 1 wherein the light source emits light in a direction that is generally forwardly and transverse to the linear actuation direction.

5. The lighted headgear of claim 1 wherein the light source emits light in a direction that is generally forwardly and downwardly from the light module.

6. The lighted headgear of claim 1 wherein the rearward inclined wall portion is generally planar and extends at an acute angle relative to the central axis.

7. The lighted headgear of claim 6 wherein the acute angle is in a range of approximately 5 degrees to approximately 40 degrees.

8. The lighted headgear of claim 1 wherein the actuator includes a resilient button and a plunger, and the rearward inclined wall portion has an opening for receiving the resilient button, the resilient button being deformable by the user to depress the plunger in the linear actuation direction.

9. Lighted headgear comprising:

a head fitting portion for fitting on a head of a user;

a brim portion extending generally forwardly from the head fitting portion, the brim portion having a generally downwardly-facing surface; and a light module mounted to the generally downwardly-facing surface of the brim portion, the light module including:

a housing having a forward opening, an LED oriented to emit light through the forward opening, a light transmitting cover distinct from, adjacent to and extending over the LED, and a reflector disposed in the forward opening and including a rearward opening aligned with the LED and a reflective upper wall extending generally forwardly from the rearward opening, the LED and the light transmitting cover such that the forward opening is unobstructed by a light transmitting cover member or lens member at the forward opening and light emitted from the LED is reflected away from the generally downwardly-facing surface of the brim portion and through the unobstructed forward opening.

10. The lighted headgear of claim 9 wherein the reflector includes a pair of opposing reflective side walls that taper away from each other as the opposing reflective side walls extend away from the reflective upper wall.

11. The lighted headgear of claim 10 wherein the reflective upper wall extends laterally between the opposing reflective side walls and extends forwardly from the rearward opening further than at least one of the opposing reflective side walls.

12. The lighted headgear of claim 9 wherein the reflector includes a reflective lower wall that extends generally forwardly from the rearward opening, and the reflective upper wall extends forwardly further than the reflective lower wall.

13. Lighted headgear comprising:

a head fitting portion for fitting on a head of a user;

a brim portion extending generally forwardly from the head fitting portion, the brim portion having a generally downwardly-facing surface; and a light module mounted to the generally downwardly-facing surface of the brim portion, the light module including:

a housing having a forward opening, a light source oriented to emit light through the forward opening, and a reflector disposed in the forward opening and including a rearward opening aligned with the light source and a reflective upper wall extending generally forwardly from the rearward opening such that light emitted from the light source is reflected away from the generally downwardly-facing surface of the brim portion and through the forward opening, wherein the reflector includes a reflective lower wall that extends generally forwardly from the rearward opening, and the reflective upper wall extends forwardly further than the reflective lower wall, the reflective upper wall tapers downwardly away from the brim portion as the reflective upper wall extends generally forwardly from the rearward opening, and the reflective lower wall tapers downwardly away from the reflective upper wall as the reflective lower wall extends generally forwardly from the rearward opening.

14. Lighted headgear comprising:

a head fitting portion for fitting on a head of a user;

a brim portion extending generally forwardly from the head fitting portion, the brim portion having a generally downwardly-facing surface; and a light module mounted to the generally downwardly-facing surface of the brim portion, the light module including:

a housing having a forward opening, a light source oriented to emit light through the forward opening, and a reflector disposed in the forward opening and including a rearward opening aligned with the light source and a reflective upper wall extending generally forwardly from the rearward opening such that light emitted from the light source is reflected away from the generally downwardly-facing surface of the brim portion and through the forward opening, wherein the reflector includes a reflective lower wall that extends generally forwardly from the rearward opening, and the reflective upper wall extends forwardly further than the reflective lower wall, the reflective upper wall tapers downwardly away from the brim portion at a first oblique angle as the reflective upper wall extends generally forwardly from the rearward opening, and the reflective lower wall tapers downwardly away from the brim portion at a second oblique angle as the reflective lower wall extends generally forwardly from the rearward opening, the second oblique angle being different than the first oblique angle.

15. Lighted headgear comprising:

a head-fitting portion for fitting on a head of a user, the head-fitting portion having a forwardly-facing surface when worn; and a light module mounted to the forwardly-facing surface, the light module including:

a housing having an interior, a light source mounted in the interior, a lower wall portion including an opening configured to permit light generated by the light source to pass therethrough, an upper wall portion having a user-operated actuator interface, and a switch device electrically coupled to the light source for selectively energizing the light source, the switch device having an actuator associated with the upper wall portion and being configured to travel in a linear actuation direction when pushed by the user, the linear actuation direction being arranged to be generally rearwardly relative to the forwardly-facing surface of the head-fitting portion for ease of operation by the user.

16. The lighted headgear of claim 15 wherein the linear actuation direction is generally rearwardly and downwardly.

17. The lighted headgear of claim 15 wherein the lower wall portion is a lower inclined wall portion that is inclined obliquely relative to the forwardly-facing surface to taper toward the forwardly-facing surface as the lower inclined wall portion extends downwardly so that light passes through the opening in the lower wall portion in a generally forward and downward direction.

18. The lighted headgear of claim 15 wherein the upper wall portion is an upper inclined wall portion that extends at an acute angle relative to the forwardly-facing surface, the acute angle being in a range of approximately 5 degrees to approximately 40 degrees.

19. The lighted headgear of claim 15, further comprising a mounting plate disposed at a rearwardly-facing surface of the head-fitting portion, wherein the housing is secured to the mounting plate such that at least a section of the head-fitting portion including the rearwardly facing and forward-facing surfaces thereof extends between and in engagement with the mounting plate and the housing.

20. A light module for mounting to an article of clothing, the light module comprising:

a housing having an interior;

a light source mounted in the housing interior;

a first inclined wall portion of the housing having a large light opening through which light from the light source is emitted;

opposite sections of the first inclined wall portion laterally spaced from each other on either side of the large opening, with the large opening having a lateral width that is larger than a lateral width of at least one of the opposite sections of the first inclined wall portion;

a switch device electrically coupled to the light source and having an actuator operable to switch the light source between on and off states; and a second inclined wall portion of the housing extending transverse to the first inclined wall portion and having an actuator opening in which a user-operated portion of the actuator is received.

21. The light module of claim 20 wherein the lateral width of the large light opening is larger than the lateral width of one of the opposite sections but smaller than a combined lateral width of the lateral width of both of the opposite sections.

22. The light module of claim 20 wherein the lateral width of the large light opening is larger than a combined lateral width of the lateral widths of both of the opposite sections.

23. The light module of claim 20 wherein the lateral width of the large light opening varies from a minimum width closest to the light source to a maximum width farthest from the light source, and the lateral widths of the opposite sections vary from a maximum width closest to the light source to a minimum width farthest form the light source.

24. The light module of claim 23 wherein the minimum lateral width of the large light opening is approximately equal to a combined lateral width of the maximum lateral widths of the opposite sections;

and the maximum lateral width of the large light opening is larger than a combined lateral width of the maximum lateral widths of the opposite sections.

25. The light module of claim 20 wherein the first and second inclined wall portions each have a generally planar configuration.

26. The light module of claim 20 wherein the first wall inclined portion and the second inclined wall portion are joined to each other to form an obtuse angle therebetween within the housing.

27. The light module of claim 20, further comprising a mounting plate having a guide slot for receiving an electrical connection therethrough.

28. The light module of claim 20, further comprising a power source located outside of the housing and electrically coupled to the switch device and the light source.

29. The light module of claim 20, further comprising a reflector mounted within the housing, the reflector including a rearward opening aligned with the light source and a plurality of reflective walls extending forwardly from the rearward opening.

30. The light module of claim 29 wherein the reflective walls extend toward a perimeter of the large light opening of the first inclined wall portion.

31. The light module of claim 30 wherein the reflective walls include a reflective lower wall, a pair of opposing reflective side walls extending away from the reflective lower wall, and a reflective upper wall extending between the opposing reflective side walls, the reflective side walls extending away from the rearward opening further than the reflective lower wall, and the reflective upper wall extending away from the rearward opening further than both of the opposing reflective side walls.

32. The light module of claim 30 wherein the reflective walls include a reflective lower wall, a pair of opposing reflective side walls extending away from the reflective lower wall, and a reflective upper wall extending between the reflective lower wall, wherein the reflective lower wall, the opposing reflective side walls, and the reflective upper wall extend a generally equal distance from the rearward opening to the large light opening.

33. The light module of claim 20, further comprising:

a circuit board disposed within the housing; and a heat sink member electrically coupled to a circuit board and including conductive material.

34. The light module of claim 33 wherein the light source is mounted on the heat sink member, and wherein the heat sink member is disposed between the light source and the circuit board such that the light source is separated from the circuit board by the heat sink member.

35. The light module of claim 33 wherein the heat sink member is an inclined heat sink member that extends generally parallel to the first inclined wall portion.

* * * * *